US007785216B2

(12) United States Patent
Hebert et al.

(10) Patent No.: US 7,785,216 B2
(45) Date of Patent: Aug. 31, 2010

(54) GOLF BALLS INCLUDING MECHANICALLY HYBRIDIZED LAYERS AND METHODS OF MAKING SAME

(75) Inventors: Edmund A. Hebert, Fairhaven, MA (US); Michael J. Sullivan, Barrington, RI (US); Derek A. Ladd, Acushnet, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 11/892,728

(22) Filed: Aug. 27, 2007

(65) Prior Publication Data

US 2009/0062036 A1 Mar. 5, 2009

(51) Int. Cl.
*A63B 37/06* (2006.01)

(52) U.S. Cl. ..... 473/373

(58) Field of Classification Search ..... 473/373, 473/374, 367

See application file for complete search history.

(56) References Cited

U.S. PATENT DOCUMENTS

| | | | | |
|---|---|---|---|---|
| 4,560,168 | A | 12/1985 | Aoyama | 473/379 |
| 4,861,644 | A | 8/1989 | Young et al. | 428/195.1 |
| 4,960,281 | A | 10/1990 | Aoyama | 473/380 |
| 5,006,297 | A | 4/1991 | Brown et al. | 264/234 |
| 5,104,126 | A | 4/1992 | Gentiluomo | 273/228 |
| 5,334,673 | A | 8/1994 | Wu | 473/378 |
| 5,484,870 | A | 1/1996 | Wu | 528/28 |
| 5,562,552 | A | 10/1996 | Thurman | 473/379 |
| 5,575,477 | A | 11/1996 | Hwang | 473/379 |
| 5,688,181 | A | 11/1997 | Albert | 473/61 |
| 5,688,191 | A | 11/1997 | Cavallaro et al. | 473/373 |
| 5,713,801 | A | 2/1998 | Aoyama | 473/354 |
| 5,733,428 | A | 3/1998 | Calabria et al. | 264/134 |
| 5,803,831 | A | 9/1998 | Sullivan et al. | 473/374 |
| 5,823,889 | A | 10/1998 | Aoyama | 473/374 |
| 5,824,746 | A | 10/1998 | Harris et al. | 525/196 |
| 5,849,168 | A | 12/1998 | Lutz | 264/255 |
| 5,850,488 | A | 12/1998 | Asai et al. | 358/1.2 |
| 5,885,172 | A | 3/1999 | Hebert et al. | 473/354 |
| 5,919,100 | A | 7/1999 | Boehm et al. | 473/354 |
| 5,957,787 | A | 9/1999 | Hwang | 473/379 |
| 5,965,669 | A | 10/1999 | Cavallaro et al. | 525/211 |
| 5,981,654 | A | 11/1999 | Rajagopalan | 525/66 |
| 5,981,658 | A | 11/1999 | Rajagopalan et al. | 525/72 |
| 6,025,442 | A | 2/2000 | Harris et al. | 525/221 |
| 6,056,842 | A | 5/2000 | Dalton et al. | 156/243 |
| 6,099,415 | A | 8/2000 | Lutz | 473/357 |
| 6,129,881 | A | 10/2000 | Puniello | 264/278 |
| 6,149,535 | A | 11/2000 | Bissonnette et al. | 473/354 |
| 6,180,040 | B1 | 1/2001 | Ladd et al. | 264/248 |
| 6,180,722 | B1 | 1/2001 | Dalton et al. | 525/193 |
| 6,207,784 | B1 | 3/2001 | Rajagopalan | 528/71 |
| 6,213,898 | B1 | 4/2001 | Ogg | 473/383 |
| 6,225,361 | B1 | 5/2001 | Nakajima | 521/57 |

(Continued)

OTHER PUBLICATIONS

U.S. Appl. No. 09/442,845, filed Nov. 19, 1999, entitled "Mold For Golf Ball".

*Primary Examiner*—Raeann Trimiew
(74) *Attorney, Agent, or Firm*—Hanify & King, P.C.

(57) ABSTRACT

Golf balls having at least one layer that is formed from a mechanically hybridizing two or more materials. In particular, the mechanically hybridized layers of the invention improve performance and increase durability of the finished golf ball, as well increase adhesion between layers.

20 Claims, 4 Drawing Sheets

U.S. PATENT DOCUMENTS 6,235,230 B1 5/2001 Puniello ..... 264/278
6,241,622 B1 6/2001 Gobush et al. ..... 473/199
6,248,804 B1 6/2001 Lutz ..... 523/160
6,286,364 B1 9/2001 Aoyama et al. ..... 73/65.03
6,290,615 B1 9/2001 Ogg ..... 473/378
6,315,915 B1 11/2001 Hebert et al. ..... 216/67
6,329,458 B1 12/2001 Takesue et al. ..... 524/400
6,338,684 B1 1/2002 Winfield et al. ..... 473/378
6,353,085 B1 3/2002 Mohrschladt et al. ..... 528/310
6,358,161 B1 3/2002 Aoyama ..... 473/383
6,379,138 B1 4/2002 Puniello et al. ..... 425/116
6,383,092 B1 5/2002 Ogg ..... 473/378
6,409,615 B1 6/2002 McGuire et al. ..... 473/383
6,414,082 B1 7/2002 Rajagopalan et al. ..... 525/74
6,467,130 B2 10/2002 Kurachi et al. ..... 16/438
6,475,104 B1 11/2002 Lutz et al. ..... 473/357
6,488,591 B1 12/2002 Gobush et al. ..... 473/199
6,494,795 B2 12/2002 Sullivan ..... 473/372
6,500,073 B1 12/2002 Gobush et al. ..... 473/199
6,500,495 B2 12/2002 Lutz ..... 427/500
6,548,618 B2 4/2003 Sullivan et al. ..... 528/76
6,565,455 B2 5/2003 Hayashi et al. ..... 473/371
6,565,456 B2 5/2003 Hayashi et al. ..... 473/373
6,629,898 B2 * 10/2003 Nardacci ..... 473/373
6,685,579 B2 2/2004 Sullivan ..... 473/357
6,705,959 B2 3/2004 Morgan et al. ..... 473/383
6,756,436 B2 6/2004 Rajagopalan et al. ..... 524/322
6,793,592 B2 9/2004 Sullivan et al. ..... 473/371
6,796,912 B2 9/2004 Dalton et al. ..... 473/383
6,800,690 B2 10/2004 Rajagopalan et al. ..... 525/183
6,815,480 B2 11/2004 Statz et al. ..... 524/322
6,835,794 B2 12/2004 Wu et al. ..... 528/64
6,849,667 B2 2/2005 Haseyama et al. ..... 521/170
6,877,974 B2 4/2005 Puniello et al. ..... 425/116
6,998,445 B2 2/2006 Ladd et al. ..... 525/261
7,011,760 B2 3/2006 Wang et al. ..... 210/660
7,041,769 B2 5/2006 Wu et al. ..... 528/61
7,071,406 B2 7/2006 Smalley et al. ..... 136/252
7,090,798 B2 8/2006 Hebert et al. ..... 264/255
7,101,944 B2 9/2006 Rajagopalan ..... 526/254
7,150,615 B2 12/2006 Sugihara et al. ..... 425/4 R
2004/0254255 A1 * 12/2004 Sullivan et al. ..... 521/143

* cited by examiner

GOLF BALLS INCLUDING MECHANICALLY HYBRIDIZED LAYERS AND METHODS OF MAKING SAME

FIELD OF THE INVENTION

The present invention relates to golf balls having at least one layer that is formed from a mechanically hybridizing two or more materials. In particular, the mechanically hybridized layers of the invention improve performance and increase durability of the finished golf ball, as well increase adhesion between layers.

BACKGROUND OF THE INVENTION

Golf ball manufacturers have been experimenting with various materials and manufacturing methods for golf balls over the years in an attempt to improve overall performance and durability and to further refine the manufacturing process.

For example, a ball that includes at least one cover layer formed from an ionomeric resin is popular design among golf ball manufacturers due to the durability and performance characteristics (including scuff resistance and rebound) associated with the material. However, the recent trend toward light stable cover materials such as aliphatic polyurethane and polyurea has introduced durability and adhesion issues, particularly when the inner cover layer is formed from an ionomer resin and the outer cover layer is formed from polyurethane or polyurea. In an effort to remedy this issue, the inner components of most commercially available polyurethane- or polyurea-covered golf balls are surface treated, e.g., corona discharge/silane dipping, to overcome the adhesion problems. The surface treatment, however, adds cost and time to the manufacturing process.

Some manufacturers have attempted to use highly neutralized polymers in place of the typical cover layer materials, i.e., inner and outer cover layers, in an attempt to overcome the problems addressed above. Potential compatibility issues remain with these fatty acid-based highly neutralized polymers, such as those discussed in U.S. Pat. No. 6,329,458, however, due to their hydrophobic backbone moiety. For example, the fatty acids may vaporize during injection molding, generating a large amount of gas, which may lead to molding defects, including adhesion problems. In particular, when such a highly neutralized polymer is used as an inner cover layer with a polyurethane or polyurea cover layer disposed thereon, the highly neutralized polymer behaves like soap and prevents the materials of the outer cover layer from properly adhering to the inner layer. In addition, the presence of this gas may also result in gas constituents settling on the surface of the molded object, which greatly lowers the paintability or post-processing options.

There are many examples of such incompatibility between layers due to the materials used therein, which, at a minimum, affect the adhesion between the layers, and ultimately affect the performance of the ball. In fact, numerous materials have beneficial qualities to golf ball manufacturers, but, because of certain detrimental qualities, these materials cannot be used independently of other more conventional materials. For example, a material with poor moisture resistance, poor durability, or low resiliency would not be useful on its own to form a layer of a golf ball. These type of materials are generally blended with other materials or not used at all.

Thus, a need exists in the golf ball art to find a way to use materials typically discounted for golf ball layers in a way that capitalizes on the beneficial nature of the material while at the same time minimizing or completely overcoming the detrimental qualities. In addition, a need exists for a method to partner complimentary, but typically incompatible, materials in adjacent golf ball layers sans the use of conventional surface treatment options to produce a golf ball with excellent layer adhesion and improved performance characteristics. As such, it would be advantageous to form a hybrid golf ball component or, in other words, a layer construction that mechanically bonds to otherwise incompatible layers together.

SUMMARY OF THE INVENTION

The present invention is directed to a golf ball including at least one mechanically hybridized component including a first layer formed of a first composition comprising at least one polyolefin polymer and a plurality of porosity-generating agents, wherein the first layer comprises a network of interconnecting pores, and a second layer disposed thereon comprising a second composition, wherein the second composition fills the interconnecting pores to form the mechanically hybridized component.

In one embodiment, the plurality of porosity-generating agents includes finely divided particles, microballoons, nanotubes, macrospheres, and combinations thereof. In another embodiment, the porosity-generating agents are microballoons comprising a thermoplastic shell. The thermoplastic shell may be formed from (meth)acrylonitrile, (meth)acrylates, styrenic monomers, vinyl halides, vinylidene halides, vinyl acetate, butadiene, vinylpyridine, chloroprene, and mixtures thereof.

In this aspect of the invention, the microballoons have a diameter of about 30 μm to about 200 μm. In one embodiment, a first percentage of microballoons have a diameter of about 10 μm to about 200 μm and a second percentage of microballoons have a diameter of about 500 μm to about 1000 μm. In another embodiment, each microballoon comprises a blowing agent within the thermoplastic shell, and wherein the thermoplastic shell is expandable by about four to about five times the initial size. In yet another embodiment, the interconnecting pores have a volume average diameter of about 0.02 microns to about 50 microns.

In still another embodiment, the porosity-generating agents are nanotubes having diameters from about 20 nm to about 400 nm.

The present invention also relates to a golf ball including a core and a mechanically hybridized component disposed about the core, wherein the mechanically hybridized component includes: a first layer formed from a composition including a thermoplastic material and a plurality of porosity-generating agents selected from the group consisting of microballoons, nanotubes, macrospheres, or a combination thereof, and a second layer formed from a castable reactive liquid material.

In this aspect of the invention, the thermoplastic material may include a highly neutralized polymer having at least 80 percent of its acid groups neutralized. In addition, the plurality of porosity-generating agents may be nanotubes having diameters from about 3 nm to about 100 nm and lengths up to 200 μm. In an alternate embodiment, the plurality of porosity-generating agents are macrospheres having diameters from about 0.001 mm to about 10 mm. For example, the plurality of porosity-generating agents may be macrospheres having diameters from about 0.01 mm to about 1 mm.

The present invention is also directed to a golf ball including a core and a cover, wherein the cover is formed of a mechanically hybridized component including: a first layer comprising a first composition including polymer component and a blowing agent, wherein the first layer comprises a first network of interconnecting pores; and a second layer including a second composition, wherein the second composition fills the first network of interconnecting pores to form the mechanically hybridized component.

The second layer may further include a plurality of porosity-generating agents selected from the group consisting of microballoons, nanotubes, or a mixture thereof, and wherein the second layer further comprises a second network of interconnected pores. In addition, the mechanically hybridized component may further include a third layer disposed about the second layer, wherein the third layer is formed from a third composition, and wherein the third composition fills the second network of interconnected pores to form the mechanically hybridized component.

DETAILED DESCRIPTION OF THE INVENTION

Figure 1:
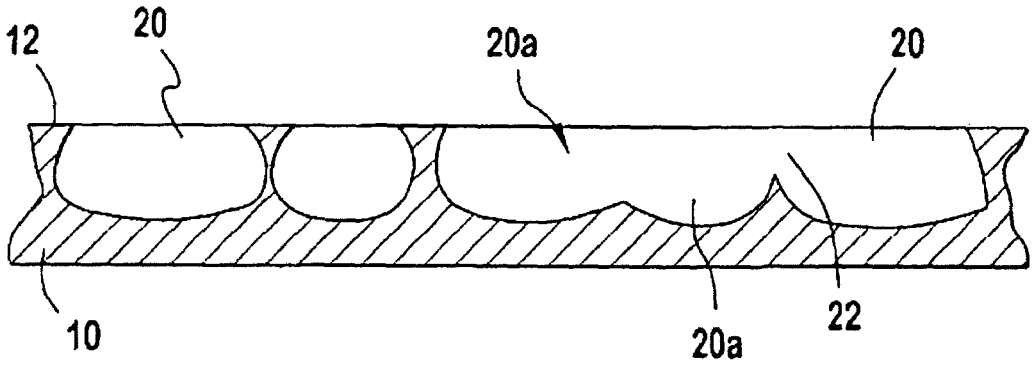
FIG. 1 is a sectional view of the surface of a first layer of a MHC where the exposed portions of the surface not covered by a maskant were milled or etched away to provide undercut and interconnected recesses.

The present invention is directed to a golf ball including mechanically hybridized component of a golf ball. In particular, the present invention relates to a golf ball having a multiple layer construction formed by mechanical hybridization. In addition, the present invention relates to methods of forming components of a golf ball using mechanical hybridization. The use of a mechanically hybridized component (MHC) according to the present invention in a golf ball advantageously improves layer adhesion and overall performance and durability.

The MHC includes at least two structural layers. In one embodiment, the MHC includes at least three structural layers. A MHC may be included in a golf ball as a replacement for any conventional component, i.e., e.g., core, cover, and any layers therebetween. All types of golf balls are contemplated by the present invention, i.e., the MHCs of the invention may be used in unitary balls, two-layer balls, three-layer balls, and balls having more than three-layers, which will be discussed in more detail below.

The use of at least one MHC in a golf ball reduces or eliminates the need for surface treatment between adjacent layers. For example, when a MHC is used as a cover, adhesion issues are reduced or completely eliminated as compared to conventional inner and outer cover layer constructions.

Mechanically Hybridized Components

A MHC according to the present invention may be formed in a variety of ways. For example, at least one layer of the MHC may be foamed. In the alternative, at least one layer of the MHC may include porosity-generating agents such as finely divided particles, microballoons, nanotubes, or macrospheres. In addition, at least one layer of the MHC may be subjected to surface texturing to change the morphology of the surface of the layer. Each of these aspects of the invention are discussed in greater detail below.

Base Resins and Compositions

Regardless of the resultant "product" used for each layer of the MHC, i.e., whether the composition used to form a layer of the MHC is a) foamed, b) infused with porosity-generating agents such as finely divided particles, microballoons, nanotubes, and/or macrospheres, or c) surface-textured, each layer is based on a resin or polymer component. In this regard, the polymer component of the present invention may be any suitable polyolefin polymer. The polymer component may be a single polymer or mixture of polymers including homopolymers, copolymers, random copolymers, block copolymers, graft copolymers, atactic polymers, isotactic polymers, syndiotactic polymers, linear polymers, or branched polymers. When mixtures of polymers are used, the mixture may be homogeneous or it may comprise two or more polymeric phases.

Nonlimiting examples of suitable polymer components include thermoplastic polyolefins, poly(halo-substituted olefins), polyesters, polyamides, polyurethanes, polyureas, poly (vinyl halides), poly(vinylidene halides), polystyrenes, poly (vinyl esters), polycarbonates, polyethers, polysulfides, polyimides, polysilanes, polysiloxanes, polycaprolactones, polyacrylates, and polymethacrylates. In addition, thermoplastic poly(ester-amides), poly(silane-siloxanes), and poly (ether-esters) are suitable for use with the present invention.

In one embodiment, the polymer component of the MPC is preferably a polyolefin polymer, such as low density polyethylene (LDPE), high density polyethylene (HDPE), polytetrafluoroethylene, polypropylene (atactic, isotactic, or syndiotactic) and copolymers thereof, ethylene copolymer, propylene copolymer, copolymers of ethylene and propylene, copolymers of ethylene and butene, ethylene acrylic acid ionomers, ethylene methacrylic acid ionomers, polystyrene, poly(omega-aminoundecanoic acid) poly(hexamethylene adipamide), poly(epsilon-caprolactam), poly(methyl methacrylate), poly(vinyl acetate), poly(vinyl chloride), poly(vinylidene chloride), copolymers of vinylidene chloride and vinyl acetate, copolymers of vinylidene chloride and vinyl chloride, and mixtures thereof. In another embodiment, the polyolefin polymer is a linear ultrahigh molecular weight polyolefin, such as ultra high molecular weight polyethylene.

In yet another embodiment, the composition includes a polymer component including at least one of a thermoplastic or thermoset material. Nonlimiting examples include, but are not limited to, ionomer resins; grafted and ungrafted metallocene-catalyzed polymers, such as those disclosed in U.S. Pat. No. 6,414,082 (incorporated by reference in its entirety); single site catalyzed olefinic polymers, such as those disclosed in U.S. Pat. No. 6,467,130 (incorporated in its entirety by reference herein); thermoplastic and thermoset polyurethanes (those having purely urethane groups as well as those having a portion of urea groups); thermoplastic and thermoset polyureas (those having purely urea groups as well as those having a portion of urethane groups); polyurethane-ionomers and polyurea-ionomers, such as those disclosed in U.S. Pat. No. 6,207,784 (incorporated in its entirety by reference herein); polybutadiene; polyisoprene; ethylene propylene rubber; ethylene propylene diene monomer; styrene diene rubber block copolymers; polyamide; polyester; polyester-amide block copolymers, such as PEBAX® (manufactured by Atofina); polyester-ether block copolymers, such as HYTREL® (manufictured by DuPont); polyethylene-acrylic or methacrylic acid copolymers, such as NUCREL® (manufactured by DuPont) and PRIMACOR® (manufactured by Dow); polyethylene-acrylic or methacrylic acid terpolymers, such as ESCOR® ATX (manufactured by Exxon Chemical Co.) and NUCREL®; or mixtures thereof.

The ionomer component useful in the present invention is a polymer that includes negatively charged acid groups, such as carboxylate or sulfonate, or positively charged basic groups, such as quaternary nitrogen, the acidic or basic groups being at least partially neutralized with a conjugate acid or base. The negatively charged acid groups may be partially, highly, or fully neutralized with a cation, such as a metal ion, whereas positively charged basic groups may be neutralized with an anion, such as a halide, an organic acid, or an organic halide. For the purposes of this invention, the term "partially neutralized" generally includes acid groups neutralized from about 20 mol percent to about 80 mol percent, the term "highly neutralized" generally includes acid groups neutralized from about 81 mol percent to about 99 mol percent, and the term "fully neutralized" includes acid groups neutralized to 100 mol percent. Methods of incorporating the acidic or basic groups are described in U.S. Pat. No. 6,353,058, which is incorporated by reference herein in its entirety.

The ionomers useful in the compositions of the invention are typically thermoplastic ionomers, and include, but are not limited to, olefin, polyester, copoly(ether-ester), copoly(ester-ester), polyamide, polyether, polyurethane, polyacrylate, polystyrene, SBS, SEBS, and polycarbonate homopolymer, copolymer and block copolymer ionomers. In one embodiment, the ionomer is a copolymer of an olefin and an α,β-ethylenically unsaturated carboxylic acid, where at least a portion of the carboxylic acid groups are at least partially neutralized with a metal ion. In another embodiment, the olefin is ethylene, and the α,β-ethylenically unsaturated carboxylic acid is acrylic or methacrylic acid, where the metal ion is zinc, sodium, magnesium, manganese, calcium, lithium or potassium.

In one embodiment, at least one layer of a MHC of the invention is based on a composition that includes a grafted metallocene-catalyzed polymer formed by grafting an ethylenically-unsaturated monomer onto a metallocene-catalyzed polymer selected from the group consisting of polyethylene and copolymers of ethylene with propylene, butene, pentene, hexene, heptene, octene, and norbornene. In another embodiment, the grafted metallocene-catalyzed polymer is formed by grafting an ethylenically-unsaturated monomer onto a metallocene-catalyzed polymer selected from the group consisting of polyethylene and copolymers of ethylene with butene.

In addition, novel hybrid materials, such as glass ionomers, ormocers, and other inorganic-organic materials, such as the ones disclosed in co-pending U.S. Pat. No. 6,793,592, the disclosure of which is incorporated by reference, may be used in the compositions of the present invention. As used herein, the term "hybrid material" includes glass ionomers, resin-modified glass ionomers, ormocers, inorganic-organic materials, silicon ionomers, dental cements or restorative compositions, polymerizable cements, ionomer cements, metal-oxide polymer composites, ionomer cements, aluminofluorosilicate glasses, fluoroaluminosilicate glass powders, polyalkenoate cements, flexible composites, and blends thereof.

As known to those of ordinary skill in the art, the intrinsic viscosity of a polyolefin polymer will vary depending on the type of polyolefin. One suitable way of determining intrinsic viscosity of the polymer component is exptrapolate to zero concentration the reduced viscosities of several dilute solutions of the polyolefin where the solvent is freshly distilled decahydronaphthalene to which 0.2 percent by weight 3,5-di-tert-butyl-4-hydroxyhydrocinnamic acid, neopentanetetryl ester has been added. This method is further explained in U.S. Pat. No. 4,861,644, which is incorporated in its entirety by reference herein. The intrinsic viscosity of the polyolefin polymer is preferably about 6 deciliters/gram (dL/g) or greater. While there is no particular upper limit on the intrinsic viscosity, in one embodiment, the intrinsic viscosity is about 39 dL/g or less. In one embodiment, the intrinsic viscosity is about 19 dL/g or greater. In another embodiment, the intrinsic viscosity is about 18 dL/g or less.

The polymer component of the composition may be present in an amount from about 10 percent to about 100 percent by weight of the composition. In one embodiment, the polymer component is present in an amount of about 15 percent or greater by weight of the composition. In another embodiment, the polymer component is present in an amount of about 90 percent or less by weight of the composition. In yet another embodiment, the polymer component is present in an amount of about 20 percent to about 80 percent by weight of the composition. In still another embodiment, the polymer component is present in an amount of about 50 percent to about 99 percent by weight of the composition.

As discussed below, the base resin or polymer component may include a blowing agent or porosity-generating agents such as finely divided particles, microballoons, nanotubes, macrospheres, or a mixture thereof. As such, the composition used to form at least one layer of the MHC may be prepared by mixing together the polymer component, any of the porosity-generating agents, and additives or processing aids as necessary until a substantially uniform mixture is obtained.

Foamed Layers

In one embodiment, the MHC is fabricated by foaming a base composition to form at least one layer of the MHC. For example, a suitable MHC includes a first layer formed from a first component, which may or may not be foamed, and the second layer formed of a second component, which may or may not be foamed, that is disposed about the first layer. In this aspect of the invention, for example, the first component may be formed from a foamed resin. Once the first layer is formed, a second layer may be disposed about the first layer by compression molding, casting, injection molding, or other molding method depending on the material used to form the encasing layer. The second layer (or any additional layers incorporated into the MHC) may also be foamed.

In particular, any thermoplastic resin that can normally be injection molded in a non-foamed state is suitable for use as the base resin for the first layer of the MHC. In particular, suitable base materials include, but are not limited to, polyethylene, such as low density polyethylene, linear low density polyethylene, medium density polyethylene, high density polyethylene, ultra-high molecular-weight polyethylene and cyclic polyethylene; ethylene-based copolymers such as ethylene-acrylate copolymer and ethylene-vinylacetate copolymer; homopolypropylene; phenolic resins; epoxy resins; polyurethanes; polyureas; polyvinyl esters; polyamides; random copolymers of propylene and α-olefins, such as ethylene, butene, pentene, hexene and octene; polypropylene block copolymers, such as ethylene-propylene block copolymer; olefin resins, such as polybutene and polymethylpentene; rubbers and elastomers, such as polybutylene, polyisobutylene, polybutadiene, natural rubber, thermoplastic polyurethane, isoprene rubber, styrene-butadiene rubber, ethylene-propylene rubber, ethylene-butene rubber, ethylene-octene rubber, ethylene-propylene-diene rubber and chloroprene rubber; cross-linked rubbers and elastomers that have been cross-linked to such extent that they can be injection molded and those ones whose flowability has been improved with polypropylene and mineral oil.

In addition, styrene-based resins, such as polystyrene and ABS resin, are suitable for high-expansion-ratio foaming. Non-crystalline resins, such as polyvinyl chloride, high nitrile resin, methyl polyacrylate, polymethylmethacrylate and polycarbonate and engineering plastics are also suitable for use in forming the first layer. For example, polymethyl pentene, polyphenylene ether, polyphenylene oxide, polyacetal, polyethylene terephthalate, polypropylene terephthalate, polybutylene terephthalate, polylactate, polyether ketone, polyether sulphone, nylon 6, nylon 11, nylon 12, nylon 66, nylon 610, nylon 612, liquid crystal polymer, polyimide, poly-p-phenylene terephthalate and polysulfone may be used to form the first layer.

In one embodiment, either layer of a MHC according to the invention is based on a foamed ionomer. For example, ethylene copolymers produced from the copolymerization of ethylene with a comonomer containing a carboxylic group (COOH) such as methyl acrylic acid may be foamed and used in the either layer of a MHC component of the invention.

Highly neutralized polymers (HNPs) are also contemplated for use in foaming the first layer of the MHC. Suitable HNPs can be thermoplastic or thermoset polymers and have at least 80 percent of the acid contained therein neutralized. The present invention also contemplates the use of fully neutralized polymers (FNPs), where 100 percent of the acid is neutralized. For the purposes of this application, a reference to HNP can be read to include FNP when 100 percent of the acid is neutralized.

Nonlimiting examples of HNPs for use according to the invention include those highly neutralized polymers or copolymers disclosed in U.S. Pat. No. 6,815,480. More specifically, suitable highly neutralized polymers include, but are not limited to, compositions including (a) an ethylene, $C_{3-8}$ $\alpha,\beta$-ethylenically unsaturated carboxylic acid copolymer, (b) a high molecular weight, monomeric organic acid or salt thereof, and (c) a cation source, where (c) is preferably present at a level sufficient to neutralize the combined acid content of (a) and (b). This HNP can also be blended with (d) a thermoplastic elastomer polymer selected from copolyetheresters, copolyetheramides, block styrene polydiene thermoplastic elastomers, elastomeric polyolefins, and thermoplastic polyurethanes. In this aspect, component (b) may be present in an amount of about 10 to about 45 weight percent of (a), (b) and (d) provided that component (b) does not exceed 50 weight percent of (a) plus (b); and component (d) is present at about 1 to about 35 weight percent of (a), (b) and (d).

Another suitable highly neutralized composition includes (a) a salt of a high molecular weight organic acid and (b) an acid containing copolymer ionomer. This HNP may be blended with (c) a thermoplastic polymer selected from copolyesteresters, copolyetheramides, block styrene polydiene thermoplastic elastomers, elastomeric polyolefins, and thermoplastic polyurethanes.

Suitable HNPs also include a melt processable thermoplastic composition of a highly neutralized ethylene acid copolymer. This composition preferably includes (a) aliphatic, mono-functional organic acid(s) having fewer than 36 atoms and (b) an ethylene, $C_{3-8}$ $\alpha,\beta$-ethylenically unsaturated carboxylic acid copolymer(s) and ionomer(s) thereof. For example, the composition may include a melt-processable HNP of ethylene, $C_{3-8}$ $\alpha,\beta$-ethylenically unsaturated carboxylic acid copolymers that have their crystallinity disrupted by addition of a softening monomer or other means, such as high acid levels, and a non-volatile, non-migratory agents such as organic acids or salts selected for their ability to substantially or totally suppress any remaining ethylene crystallinity.

Other suitable HNPs include those disclosed in U.S. Pat. No. 6,756,436, which generally discloses HNPs containing an acid group neutralized by an organic acid or a salt thereof, the organic acid or salt thereof being present in an amount sufficient to neutralize the polymer by at least about 80 percent. This polymer may be blended with ionomeric copolymers and terpolymers, ionomer precursors, thermoplastics, thermoplastic elastomers, polybutadiene rubber, balata, grafted metallocene-catalyzed polymers, non-grafted metallocene-catalyzed polymers, single-site polymers, high-crystalline acid polymers, cationic ionomers, and mixtures thereof. Nonlimiting examples of organic acids for use in making the HNP include aliphatic organic acids, aromatic organic acids, saturated mono-functional organic acids, unsaturated mono-functional organic acids, multi-unsaturated mono-functional organic acids, and mixtures thereof. In one embodiment, the salt of an organic acid includes the salt of barium, lithium, sodium, zinc, bismuth, chromium, cobalt, copper, potassium, strontium, titanium, tungsten, magnesium, cesium, iron, nickel, silver, aluminum, tin, calcium, stearic, bebenic, erucic, oleic, linoleic, dimerized derivatives, and mixtures thereof.

Foaming of any of the above materials may be accomplished in several ways. One suitable method is through the use of a blowing agent or chemical foaming agent, i.e., any agent that releases gas at certain temperatures and pressures. Suitable blowing agents include, but are not limited to, nitrogen-based azo compounds such as 2,2'-azobis(2-cyanobutane), 2,2'-azobis(methylbutyronitrile), azobisisobutylonitrile, azodicarbonamide, p,p'-oxybis(benzene sulfonyl hydrazide), p-toluene sulfonyl semicarbazide, p-toluene sulfonyl hydrazide, and mixtures thereof. These blowing agents are commercially available from Crompton Uniroyal Chemical in the United States and the United Kingdom, and from Hepce Chemical in Korea, among others.

In addition, mixtures of polycarboxylic acids and inorganic carbonic acid compounds are useful in the foaming process. Suitable polycarboxylic acids include, but are not limited to, citric acid, oxalic acid, fumaric acid, phthalic acid, malic acid, tartaric acid, cyclohexane-1,2-dicarboxylic acid, camphric acid, ethylenediamine tetraacetic acid, triethylenetetramine hexaacetic acid, nitrilo acid, and mixtures thereof. Inorganic carbonic acid compounds suitable for use in such mixtures include, but are not limited to, sodium hydrogencarbonate, sodium hydrogencarbonate aluminum and potassium hydrogencarbonate, salts of polycarboxylic acids, such as sodium dihydrogen citrate and potassium hydrogenoxalate, and mixtures thereof.

For example, a mixture of polycarboxylic acid and an inorganic carbonic acid compound is useful when foaming polyolefins. In one embodiment, the chemical foaming agent is a mixture of citric acid and sodium hydrogen carbonate. Without being bound to any particular theory, it is believed that when a chemical foaming agent is used, microcells are formed, i.e., a large amount of form nuclei are present, and the resultant foam layer has a uniform appearance.

If used, a chemical foaming agent is preferably added in an amount of about 0.01 to 1 percent by weight of the resin, more preferably about 0.05 to 0.8 weight percent. The chemical foaming agent may be mixed with the resin in advance of foaming or at the time of injection molding.

In one embodiment, at least one layer of the MHC is a self-expanding foam. For example, a layer is formed of a base material, such as the examples provided above, at least two chemical constituents: one to decompose into a gas to form the bubbles, and one to form the walls of the cells.

Physical foaming agents may also be employed to foam the materials above. Suitable examples of physical foaming agents include, but are not limited to vapors of organic solvents having low boiling point such as methanol, ethanol, propane, butane and pentane; vapors of halogen-based inert solvents such as dichoromethane, chloroform, carbon tetrachloride, and nitrogen trifluoride; and inert gases such as carbon dioxide, nitrogen, argon, helium, neon and astatine.

When a physical foaming agent is used, the process by which the first layer is foamed may be similar to the process described in U.S. Pat. No. 7,150,615. In particular, a suitable injection foaming process for use with the present invention includes one that continuously or intermittently supplying a physical foaming agent from a storage tank to the cylinder of an injection molding machine through a hole made in the middle of the cylinder. In other words, the physical foaming agent is supplied to the injection molding machine at low and constant pressure through a pressure reducing valve. The physical foaming agent injection hole is positioned in the range from the starting point of the second stage of the screw to a length nine times the outside diameter of the screw in the direction of injection when the screw is caused to advance most forward in the direction of injection. In addition, the cylinder has a two-stage-compression screw that carries out compression by slowly reducing the volume of the grooves in the direction of injection so that the resin is sent in the direction of injection, with the ratio of is L2/L1 (where L1 is the depth of the last groove of the first stage and L2 is the depth of the first groove of the second stage) being in the range of 1.2 to 6. The pressure of the physical foaming agent is reduced to not more than 80 percent against the storage pressure and the volume of the cavity of the mold is expanded by bringing the pressure inside the cavity to atmospheric pressure after the injection and filling of the resin. In an alternate embodiment, the physical foaming agent is supplied to the injection molding machine by pressurizing the agent with a pump or the like.

Those of ordinary skill in the art will be aware of suitable methods for foaming compositions useful in the layers of the MHC. For example, U.S. Pat. No. 6,849,667 discloses a method of foaming polyurethane that includes dissolving carbon dioxide in molten thermoplastic polyurethane resin and then cooling the composition and U.S. Pat. No. 7,150,615 discloses methods and apparati for foaming thermoplastic resins.

Finely Divided Particles

Suitable porosity-generating agents for use with the present invention include finely divided particles, e.g., solid microspheres and nanospheres. In particular, finely divided particles may be incorporated into a base resin or polymer to form at least one layer of a MHC according to the invention. Suitable fine particles include, but are not limited to, inorganic substances, such inorganic fillers as talc, calcium carbonate, magnesium carbonate, aluminum hydroxide, magnesium hydroxide, barium sulfate, mica, day, alumina, iron oxide, titanium oxide, magnesia, carbon black and graphite.

In addition, siliceous particles may be used in a composition of the invention to increase pore diameter uniformity of the resultant layer of the MHC. Because of the generic structure of silicates, i.e., a tetrahedron shaped anionic group:

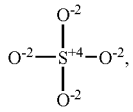

the oxygen atoms have the option of bonding to another silicon ion and, therefore, linking one silicate to another. Thus, the silicates are beneficial in the compositions of the invention due to the different ways that silicate tetrahedrons combine, i.e., as single units, double units, sheets, chains, rings, and framework structures. For example, the tectosilicate subclass have structures composed of interconnected tetrahedrons going outward in all directions forming an intricate framework analogous to the framework of a large building. Thus, layers of the MHCs may have interconnected pores due, at least in part, to the interconnected tetrahedrons of the silicates included in the composition.

Examples of suitable silicates include, but are not limited to, those in the nesosilicate group (single tetrahedrons), the sorosilicate group (double tetrahedrons), the inosilicate group (single and double chains), the cyclosilicate group (rings), the phyllosilicate group (sheets), and the tectosilicate group (frameworks). Specific examples include, but are not limited to, silica; mica (e.g., biotite, lepidolite, muscovite, phlogopite, and zinnwaldite), montmorillonite, kaolinite (aluminum silicate hydroxide); asbestos; talc (magnesium silicate hydroxide); diatomaceous earth; vermiculite; natural and synthetic zeolites (e.g., analcime, chabazite, harmotome, heulandite, laumontite, mesolite, natrolite, phillipsite, scolecite, stellerite, stilbite, and thomsonite); cement; wollastonite (calcium silicate); andalusite, kyanite, and sillimanite (aluminum silicate); albite (sodium aluminum silicate); aluminum polysilicate; and glass particles.

The silicate may be in the form of ultimate particles, aggregates of ultimate particles, or mixtures thereof. For example, the silicate may be precipitated silica, a silica gel, fumed silica, or a combination thereof. As known to those of ordinary skill in the art, the different types of silicates have different properties. For example, silica gel does not precipitate and is a coherent, rigid, three-dimensional network of contiguous particles of colloidal amorphous silica, whereas precipitated silica includes precipitated aggregates of ultimate particles of colloidal amorphous silica that have not existed at any time as macroscopic gel. In addition, precipitated silica powders typically have a more open structure, i.e., a higher specific pore volume, but tend to have lower specific surface area than silica gel.

In one embodiment, precipitated silica is used in the composition with the polymer component. The precipitated silica is typically produced by combining an aqueous solution of a soluble alkali metal silicate and an acid so that colloidal particles will grow in weakly alkaline solutions and be coagulated by the alkali metal ions of the resulting soluble alkali metal salt. The acid may be one of sulfuric acid, hydrochloric acid, carbon dioxide, or a mixture thereof.

As mentioned, the silicate may also be in the form of silica gel. For example, alumina silica gel is a suitable silicate for inclusion in the MPC. The gel form contains millions of tiny pores that adsorb and hold moisture, e.g., silica can absorb about 40 percent of its weight in moisture. In addition, fumed silica may be used in the MPC, which is beneficial, at least in part, because fumed silica particles are submicron size and are thus able to easily move through the macromolecules of the polymer component. Moreover, the three dimensional network of the fumed silica prevents pigments from settling. Suitable commercially available fumed silica includes hydrophilic and hydrophobic AEROSIL from Degussa Corp of Waterford, N.J.

The finely divided particles preferably have a particle size of about 1 nm to about 40 microns, which depends on the type of silicate used. In one embodiment, the finely divided particle is submicron size and has an average particle size of less than about 100 nm. In another embodiment, the finely divided particle has a particle size of about 50 nm or less, preferably about 30 nm or less. In an alternate embodiment, the finely divided particle has a micron particle size, e.g., about 5 microns to about 40 microns, preferably about 10 microns to about 30 microns.

The finely divided particles may be present in an amount of about 40 percent to about 90 percent of the composition. In one embodiment, about 50 percent to about 85 percent of the composition is the filler. In another embodiment, the filler is present in the composition in an amount of about 60 percent to about 80 percent by weight of the composition.

In one embodiment, the surfaces of the fine particles have been treated to increase hydrophobicity and, thus, improve dispersion. The fine particles may have a diameter between about 0.1 μm and 300 μm. The average particle size is preferably 0.5 to 10 μm. In this aspect of the invention, the microspheres or fine particles may all be the same diameter or have differing diameters. For example, about 50 percent of the fine particles may have a diameter between about 0.05 μm and 10 μm and about 50 percent may have a diameter between about 30 μm and about 70 μm.

The fine particles are preferably added in an amount of about 0.05 to 10 weight percent, more preferably about 0.1 to 5 weight percent, by weight of the resin. The particles may be present in a masterbatch where the fine particles are present in an amount of about 5 to 50 weight percent by weight of the base material (resin, wax, rubber, or the like).

Microballoons

In one embodiment, a MHC of the invention is formed by incorporating microballoons or "prefabricated" bubbles into a base resin or polymer prior to forming a layer of the MHC. In other words, the first layer of a MHC is not a blown foam created by the injection of gas or a self-expanding foam created by chemical evolution (as discussed above). Rather, the first layer is syntactic, or assembled using "prefabricated," manufactured bubbles that are mechanically combined with a resin to form a composite material. Whereas blown and self-expanding layers develop a fairly random distribution of gas pockets of widely varying sizes and shapes, the porosity of syntactic foams can be much more closely controlled by careful selection and mixing of the preformed bubbles with the matrix. As such, without being bound to any particular theory, the use of such materials in at least one layer of a MHC according to the invention increase adhesion between layers of a MHC and ultimately increase durability and performance.

The microballoons or prefabricated bubbles are distinguishable from other types of microspheres used in industry, many of which are solid, and from other microparticles, which can be irregularly shaped. In this aspect of the invention, the microballoon has a diameter of about 1 μm and about 1,000 μm. However, because "porosity" of the layers of the MHC are a function of the number and/or size (diameter) of the microballoons used in the layer, one of ordinary skill in the art would be aware that using microballoons having a larger diameter, e.g., greater than 1000 μm might be beneficial. In one embodiment, the diameter of the microballoon is from about 30 μm to about 200 μm, preferably from about 50 μm to about 100 μm. In yet another embodiment, the microballoon is about 10 μm to about 200 μm. In another embodiment, the microballoon has a diameter of about 300 μm to about 1000 μm, preferably about 500 μm to about 1000 μm.

In still another embodiment, at least two different sizes (diameters) of microballoons are included in the composition that is used to form at least one layer of the MHC. For example, the composition may include a percentage of microballoons having diameters of about 10 μm to about 200 μm and a percentage of microballoons having diameters of about 500 μm to about 1000 μm. The composition may also include at least three different sizes of microballoons. In particular, the composition may include a first set of microballoons having diameters of about 10 μm to about 200 μm, a second set of microballoons having diameters of about 300 μm to about 600 μm, and a third set of microballoons having diameters of about 700 μm to about 1000 μm.

The wall thickness of the microballoons may be from about 5 percent to about 50 percent of the diameter. In one embodiment, the wall thickness is about 10 percent to about 35 percent of the diameter.

In particular, the microballoon may be obtained by heating an expandable thermoplastic microsphere with a blowing agent trapped therein to a predetermined temperature. Any suitable thermoplastic polymer obtainable by polymerizing various monomers may be used to form the shell of the microballoon including, but not limited to, such as (meth) acrylonitrile, (meth)acrylates, styrenic monomers, vinyl halides, vinylidene halides, vinyl acetate, butadiene, vinylpyridine, chloroprene. In this aspect of the invention, the blowing agent may be included in the expandable microsphere in an amount of about 1 percent to about 40 percent by weight, preferably about 5 percent to about 30 percent by weight. In another embodiment, the shells of the microballoons are formed from styrene-4-vinylpyridine, sulfonated polystyrene, or a mixture thereof.

Any of the blowing agents discussed above may be used in this aspect of the invention. In one embodiment, the blowing agent has a boiling point not higher than the softening temperature of the thermoplastic shell including, but not limited to, n-pentane, isopentane, neopentene, butane, isobutene, hexane, isohexane, neohexane, heptane, isoheptane, octane, isooctane, and mixtures thereof.

In addition, hydrocarbons and chlorinated hydrocarbons may be used as the blowing agent in this aspect of the invention. For example, a microballoon according to this aspect of the invention consists of a thermoplastic polymeric shell with a drop of liquid hydrocarbon. The shell can expand to about four to about five times the original size, e.g., a 10 μm shell can expand to about 40 or 50 μm is diameter. Moreover, the density of the shell decreases when heated by a factor of about 10 or more, preferably about 30 or more.

As known to those of ordinary skill in the art, the predetermined temperature is obviously determined by the grade of microballoon. In one embodiment, the predetermined temperature is about 90° C. to about 260° C. In another embodiment, the predetermined temperature is about 100° C. to about 175° C.

In yet another embodiment, finely divided particles, such as calcium carbonate, may be uniformly deposited on the surface of the microballoons as disclosed in U.S. Pat. No. 6,225,361. In particular, without being bound to any particular theory, such composite beads are believed to improve the "feel" of the ball when struck with the club and increase durability.

Nanotubes

Similar to the microballoons discussed above, nanotubes may be used to build porosity into the base resins or polymers used to form at least one layer of the MHC of the invention. For example, nanotubes suitable for use with the present invention may have a diameter of about 1 nm to about 500 nm, preferably about 20 nm to about 400 nm.

In particular, single-wall nanotubes tend to be produced in clusters of 10 to 1000 single-wall carbon nanotubes in parallel alignment, held together by van der Waals forces in a closely packed triangular lattice. As such, the inclusion of such nanotubes will increase the porosity of the composition used to form at least one layer of the MHC according to the invention. Multi-wall nanotubes are also useful in the present invention. Suitable nanotubes may include single sheet wall or multi-wall forms with diameters of about 3 nm to about 100 nm and up to 200 μm long.

In addition, U.S. Pat. Nos. 7,071,406 and 7,011,760 disclose arrays of nanotubes that may be used in compositions to form at least one layer of the MHC of the invention. For example, carbon nanotubes may be formed by pyrolysis of a carbon-containing gas such as ethylene, acetylene or CO and may be grown at temperatures of about 600° C. to about 1000° C., with tube length increasing with time. As known to those of ordinary skill in the art, higher purity levels can be achieved by through alternating cycles of tube growth and oxidation to remove amorphous carbon. The as-grown carbon nanotubes are hydrophobic in nature.

It is contemplated that the nanotubes can be functionalized by treatment with a diene or known functionalizing reagents. In addition, a chemically (including biologically) reactive component or components (e.g., catalyst, catalyst precursor, electroactive polymer, enzyme) can be applied directly on the nanotubes or over the layer of the MHC containing the nanotubes.

Macrospheres

Macrospheres may also be used to increase porosity of at least one layer of the MHCs of the invention. In particular, as used herein, "macrospheres" refer to low density spheres formed from a resin binder either alone or containing reinforcing fibers such as glass fibers, carbon fibers or the like having a diameter between about 1.5 mm and about 100 mm. In one embodiment, the polymer macrospheres for use with the present invention may have diameters between about 1.5 mm and 50 mm, preferably between about 2 mm to about 10 mm. In another embodiment, the diameter of a suitable polymer macrosphere for use with the present invention is about 0.001 mm to 10 mm, more preferably 0.01 to 1 mm. In particular, the macrospheres can have an essentially uniform diameter or can have varying diameters in this range.

The interior volume of a suitable macrosphere for use with the present invention contains gas or a low density solid that also contains gas. The macrospheres can be formed of any synthetic resin composition which may include a reinforcing agent such as fibers including glass fibers, carbon fibers or the like. The macrospheres typically are formed from thermoset or thermoplastic polymers such as polyvinyl esters, polyesters, phenolic resins, epoxy resins, polyurethanes polyamides, high density polyethylene, polypropylene, polyacrylonitrile, acrylonitrile-butadiene-styrene polymers, styrene-acrylonitride or the like. The macrospheres typically are formed by conventional injection molding, such as by molding two matching hemispherical sections and joining them or rotational molding or the like.

The volume percent macrospheres of the composition is between about 40 and about 90 volume percent by weight of the composition, preferably between about 60 and about 80 volume percent by weight of the composition.

In another aspect of the invention, the nanotubes discussed above may be coated on expandable microballoons to "build" expandable thermoplastic macrospheres that are eventually incorporated into the composition used to form at least one layer of the MHC. For example, expandable microballoons and nanotubes may be dispersed in solvent and exposed to ultrasonic horn at room temperature for about one hour. The mixture may then be dried and heated to remove excess solvent. Without being bound to any particular theory, such expandable macrospheres are believed to have increased compressive strength.

Surface Texturing

In an alternative to the other ways of modifying the porosity of the layers of the MHCs of the invention described above, at least one layer of a MHC of the invention may be surface-textured through chemical, electrochemical, and mechanical milling techniques, chemical or electrochemical etching, or a combination thereof. Without being bound by any particular theory, surface texturing is believed to facilitate the use of previously incompatible materials in adjacent layers by creating irregularities in the surface of the layer(s).

Maskants can be used in milling or etching. In particular, the maskant can be engineered to be repetitive or random and/or based on complex geometries and can be any suitable acrylic, epoxy, polyester resist, or the like. The maskant can be deposited on a layer of the MHC and then the exposed surface may be milled or etched as desired.

Figure 2:
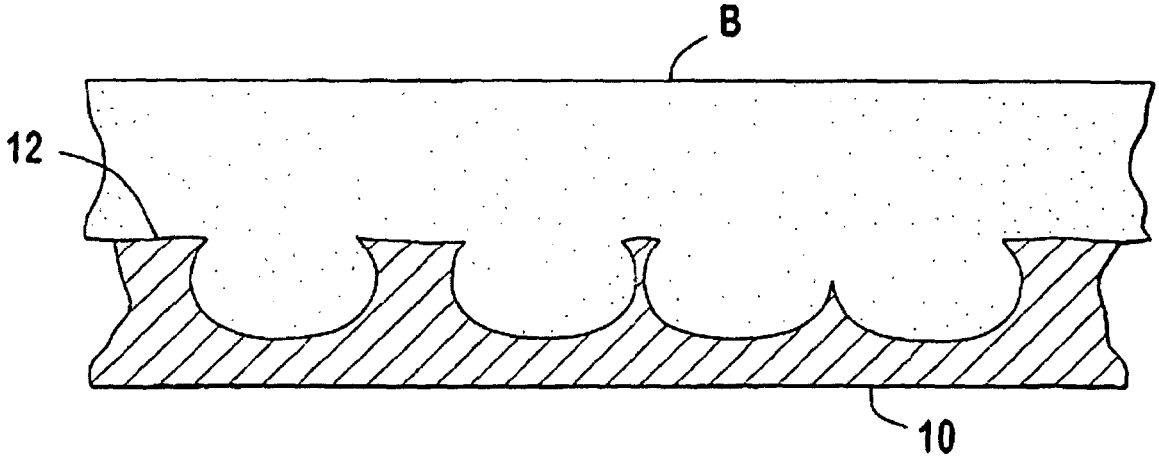
FIG. 2 is a sectional view of the interconnection of two layers of a MHC.
Figure 3:
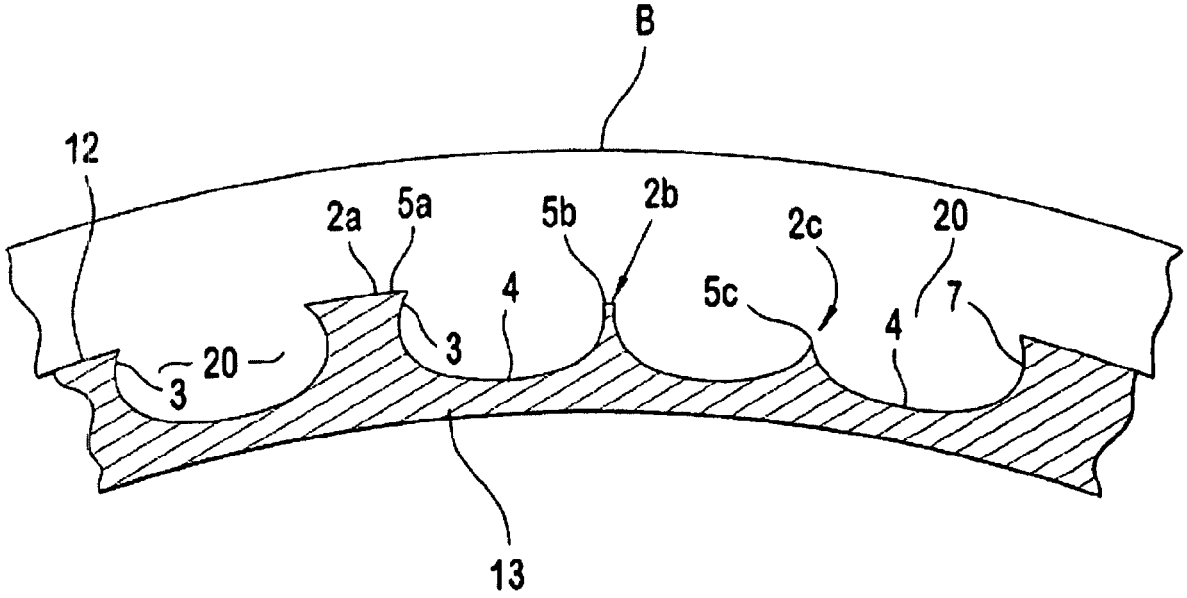
FIG. 3 is a diagrammetric view of the structural features of a surface texture according to the invention.

For example, in one embodiment, the exposed areas of the layer are milled such that recesses having an undercut are created in the exposed surface. As shown in FIG. 1, golf ball layer 10 has a top surface 12 that has recesses 20. The recesses 20 may, at least in some instances, interconnect at and near the top surface 12 as shown at 22 to provide enlarged surface recesses 20*a*. FIGS. 2 and 3 show that, when a second layer 30 is disposed atop layer 10, the material used to form the second layer 30 fills into the recesses of first layer 10. In particular, the material used to form layer 30 fills the bottoms 4 and walls 7 of the recesses 20. The undercuts 3 aid in locking the material used to form layer 30 into the first layer 10 to form a tightly connected MHC according to the invention. Protrusions 2*a*, 2*b*, 2*c* (having peaks 5*a*, 5*b*, and 5*c*, respectively) may be different, as shown in FIG. 3, to create a random pattern with which to lock the two layers of the MHC together. In another embodiment, the pattern is more uniform and, as such, the protrusions would be substantially the same.

In another embodiment, a maskant can be used to protect various portions of a first layer of the MHC from the application of a chemical etchant such that only the unprotected or unmasked area is removed with the etchant. The etching process may be repeated any number of times as necessitated by the amount and nature of the irregularities required and the particular base resin or polymer used to form the layers of the MHC. The maskant can be designed in a regular pattern or random pattern. While a number of etchants may be used, one particular embodiment envisions a 30 percent nitric acid and 6 percent hydrofluoric acid combination to be applied at a temperature of about 100° F. to about 130° F., preferably about 105° F. to about 115° F. for about 2 minutes to about 10 minutes, preferably about 3 minutes to about 6 minutes to achieve a desired depth. In one embodiment, the desired depth of the surface textures is about 0.1 mm (about 0.004 inches) to about 0.254 mm (0.010 inches).

Building the MHC

As discussed above, any layer of a MHC according to the invention may be treated or modified to aid in the mechanical hybridization of the two layers. In one embodiment, if the first layer of the MHC is foamed, the second layer of the MHC may or may not be foamed. In fact, the second layer may be disposed about the first by compression molding, casting, injection molding, or any other molding method that is suitable for the material selected for the second layer. In addition, additional layers may be built onto the MHC for structural integrity of the ball as desired.

As such, once the first layer is formed, a second layer may be disposed about the first layer. The second layer may be formed of a variety of materials, preferably materials that are normally incompatible with the material of the first layer, or require some type of surface treatment prior to application. For example, a thermoset polyurethane or polyurea may be used to form the second layer.

In another embodiment, a MHC of the invention is formed by injection foaming both the first and second layers independently and then linking the foamed layers by heating the molds. In another embodiment, the first and second foamed layers are linked after being removed from the molds. As known to those of ordinary skill in the art, the amount of physical foaming agent remaining in the first and second layers may be adjusted to increase the expansion ratio. Without being bound by any particular theory, it is believed that crosslinking after foaming provides excellent mechanical properties including compression.

In yet another embodiment, the first layer of the MHC may be formed from a base resin or composition that includes finely divided particles, microballoons, nanotubes, macrospheres, or a mixture thereof. Once the layer is formed, a second layer may be deposited about the first layer to form the MHC. This second layer may also be modified in some manner or may be left alone depending on whether the MHC includes additional layers.

If a layer of the MHC is foamed or modified with finely divided particles, microballoons, nanotubes, macrospheres, or a mixture thereof, the layer preferably has pores that constitute about 35 percent or greater of the volume of the layer. In one embodiment, the pores constitute about 35 percent to about 95 percent by volume of the layer. In another embodiment, the pores contain about 60 percent or greater by volume of the layer. Preferably, at least about 20 percent, more preferably at least about 50 percent of the pore volume is composed of pores in the size (diameter) range of about 0.1 μm to about 300 μm, more preferably about 0.3 μm to about 200 μm, and still more preferably about 1 μm to 100 μm.

As used herein, porosity is determined by the following equation:

$$\text{Porosity}=100*[1-d_1/d_2] \qquad \text{Eq. 1}$$

where $d_1$ is the density of the sample (determined from the sample weight and the sample volume obtained from sample dimensions) and $d_2$ is the density of the solid portion of the sample (determined from the sample weight and the volume of the solid portion of the sample). Pore volume and pore size distribution are measured by Mercury porisimetry (assuming cylindrical geometry of the pores) and nitrogen adsorption. As those of ordinary skill in the art are aware, mercury porisimetry and nitrogen adsorption are complementary techniques with mercury porisimetry being more accurate for measuring pore sizes larger than about 30 nm and nitrogen adsorption more accurate for smaller pores (less than 50 mm). Pore sizes in the range of about 0.1 μm to 300 μm enable molecules to diffuse molecularly through the materials under most gas phase conditions.

Calculation of the volume average diameter of the pores in a layer of a MHC according to the invention may thus be calculated as follows:

$$d=2[(v_1r_1/w_1)+(v_2r_2/w_2)]/[(v_1/w_1)+(v_2/w_2)] \qquad \text{Eq. 2}$$

where $v_1$ is the total volume of the mercury intruded in the high pressure range, $v_2$ is the total volume of the mercury intruded in the low pressure range, $r_1$ is the volume average pore radius to be determined from the high pressure scan, $r_2$ is the volume average pore radius to be determined from the low pressure scan, $w_1$ is the weight of the sample subjected to a high pressure scan, and $w_2$ is the weight of the sample subjected to a low pressure scan.

The volume average diameter of the pores may range from about 0.02 μm to about 1000 μm and higher depending on the type and amount of additive used, i.e., whether microballoons are used exclusively or in combination with nanotubes and/or macrospheres. In one embodiment, the volume average diameter of the pores is about 0.02 μm to about 50 μm. In another embodiment, volume average diameter of the pores is about 0.04 μm to about 40 μm. In yet another embodiment, the volume average diameter of the pores is about 0.05 μm to about 30 μm. In still another embodiment, the volume average diameter of the pores is about 0.02 μm to about 0.5 μm, preferably about 0.04 μm to about 0.3 μm, more preferably about 0.05 μm to about 0.25 μm.

In one embodiment, at least one layer of a MHC includes a mixture of microballoons, finely divided particles, nanotubes, and macrospheres in order to achieve a completely randomized surface with which to deposit an additional layer thereon. In another embodiment, at least one layer of a MHC includes a mixture of nanotubes and microballoons. In yet another embodiment, at least one layer includes a mixture of macrospheres and nanotubes. Based on this disclosure, a skilled artisan would understand that the amount and type of additive can be varied in order to achieve a certain porosity.

Other Polymers

Other polymers may be present in the compositions used to form the layers of the MHC as long as their presence does not materially affect the properties of the layer of the MHC in a negative manner. Suitable polymers for inclusion in a composition used to form at least one layer of a MHC include, but are not limited to, LDPE, HDPE, PTFE, polypropylene, copolymers of ethylene, copolymers of propylene, copolymers of ethylene and acrylic acid or methacrylic acid, and mixtures thereof. The carboxyl-containing copolymers may be partially or fully neutralized with metal ions.

As known to those of ordinary skill in the art, the amount of the other polymer(s) depends on the type of the polymer. For example, if the other polymer has a molecular structure with minimal branching, long sidechains, and bulky side groups, the other polymer may be incorporated into the composition in a greater amount than if the other polymer had a large amount of branching, long sidechains, or bulky side groups. In one embodiment, the other polymer(s) is present in an amount of about 0 to about 30 percent. In another embodiment, the composition used to form at least one layer of a MHC includes about 1 percent to about 20 percent other polymer. In yet another embodiment, the other polymer is present in an amount of about 1 percent to about 15 percent. In still another embodiment, the composition used to form at least one layer of the MHC is substantially devoid of other polymer.

Fillers

The compositions used to form at least one layer of the MHCs of the invention may also include various fillers. For example, fillers may be added to the compositions of the invention to affect rheological and mixing properties, the specific gravity, i.e., density-modifying fillers, the modulus, the tear strength, reinforcement, and the like. Suitable fillers include numerous metals, metal oxides and salts, such as zinc oxide and tin oxide, as well as barium sulfate, zinc sulfate, calcium oxide, calcium carbonate, zinc carbonate, barium carbonate, clay, tungsten, tungsten carbide, regrind (recycled core material typically ground to about 30 mesh particle), high-Mooney-viscosity rubber regrind, and mixtures thereof. Because these fillers are generally inorganic and can be considered nanoparticles or microparticles, the majority of these particles may overlap with the finely divided particles discussed above and/or can be considered for use as a finely divided particle in forming at least one layer of the MHCs of the invention.

In one embodiment, the compositions of the invention can be reinforced by blending with a wide range of density-adjusting fillers, e.g., ceramics, glass spheres (solid or hollow, and filled or unfilled), and fibers, inorganic particles, and metal particles, such as metal flakes, metallic powders, oxides, and derivatives thereof, as is known to those with skill in the art. The selection of such filler(s) is dependent upon the properties desired.

Other materials conventionally included in golf ball compositions may also be added to the compositions of the invention. These additional materials include, but are not limited to, reaction enhancers, crosslinking agents, optical brighteners, coloring agents, fluorescent agents, whitening agents, UV absorbers, hindered amine light stabilizers, defoaming agents, processing aids, mica, talc, nano-fillers, and other conventional additives. Antioxidants, stabilizers, softening agents, plasticizers, including internal and external plasticizers, impact modifiers, foaming agents, excipients, organic extraction liquids, reinforcing materials and compatibilizers may also be added to any composition of the invention. In addition, heat stabilizers may be beneficial in enlarging the range of processing temperatures to greater than about 130° C. The plasticizer is preferably liquid at room temperature and usually is a processing oil such as paraffinic oil, naphthenic oil, or aromatic oil. Suitable organic extraction liquids depend on the material to be extracted, however, suitable examples include, but are not limited to, 1,1,2-trichloroethylene, perchloroethylene, 1,2-dichloroethane, 1,1,1-trichloroethane, 1,1,2-trichloroethane, methylene chloride, chloroform, 1,1,2-trichloro-1,2,2-trifluoroethane, isopropyl alcohol, diethyl ether, acetone, hexane, heptane, and toluene.

Although the present invention generally addresses prior art adhesion problems, additional adhesion promoters may also be of use in the present composition. Suitable adhesion promoters include, but are not limited to, silane-containing adhesion promoters and lubricants.

All of these materials, which are well known in the art, are added for their usual purpose in typical amounts. For example, the additive(s) is preferably present in an amount of about 15 percent or less. In one embodiment, the additive is present in an amount of about 5 percent or less by weight of the composition.

Properties of the Resultant MHC

Adhesion may be measured in terms of peel strength using the T-Peel test (ASTM D-1876-72). The MHCs of the invention preferably have a dry peel strength of about 0.5 pound per linear inch (pli) and a wet peel strength of about 0.25 pli. In one embodiment, the dry peel strength is about 1 pli or greater. In another embodiment, the dry peel strength is about 1.5 pli or greater. In yet another embodiment, the wet peel strength is about 0.5 pli or greater. In still another embodiment, the wet peel strength is about 1 pli or greater.

Golf Ball Construction

The MHCs of the present invention may be used with any type of ball construction. For example, two-piece, three-piece, and four-piece golf ball designs are contemplated by the present invention. In addition, golf balls having double cores, intermediate layer(s), and/or double covers are also useful with the present invention. As known to those of ordinary skill in the art, the type of golf ball constructed, i.e., double core, double cover, and the like, depends on the type of performance desired of the ball. As used herein, the term "layer" includes any generally spherical portion of a golf ball, i.e., a golf ball core or center, an intermediate layer, and/or a golf ball cover. As used herein, the term "inner layer" refers to any golf ball layer beneath the outermost structural layer of the golf ball. As used herein, "structural layer" does not include a coating layer, top coat, paint layer, or the like. As used herein, the term "multilayer" means at least two layers.

Figure 4:
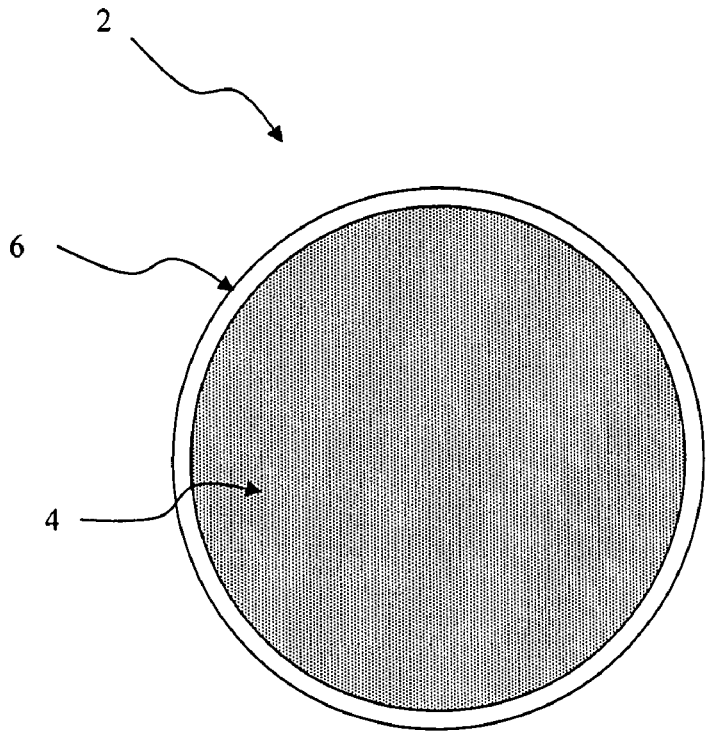
FIG. 4 is a cross-sectional view of a two layer ball, wherein at least a portion of the golf ball is formed from the compositions of the invention.

In one embodiment, a golf ball 2 according to the invention (as shown in FIG. 4) includes a core 4 and a cover 6, wherein the at least one of core 4 and cover 6 incorporates at least one MHC according to the invention. The MHC layer may incorporate traditionally incompatible layer materials, such as ionomers and polyurethanes, thus eliminating the traditionally required surface treatments to increase adhesion.

Figure 5:
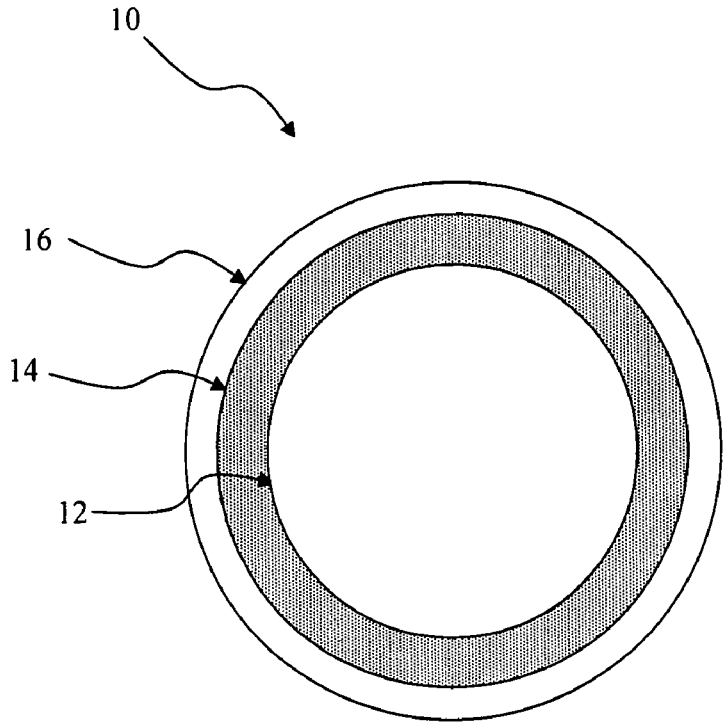
FIG. 5 is a cross-sectional view of a multi-component golf ball, wherein at least a portion of the golf ball is formed from the compositions of the invention.

Similarly, FIG. 5 illustrates a golf ball according to the invention incorporating an intermediate layer. Golf ball 10 includes a core 12, a cover 16, and an intermediate layer 14 disposed between the core 12 and cover 16. Any of the core 12, intermediate layer 14, or cover 16 may incorporate a MHC according to the invention. In one embodiment, the intermediate layer 14 is formed of the MHC of the invention, which is then enclosed by a cover 16 formed of a thermoset or thermoplastic polyurethane or polyurea material. In another embodiment, the MHC is incorporated into the cover 16 and the intermediate layer 14 is formed of conventional outer core materials.

Figure 6:
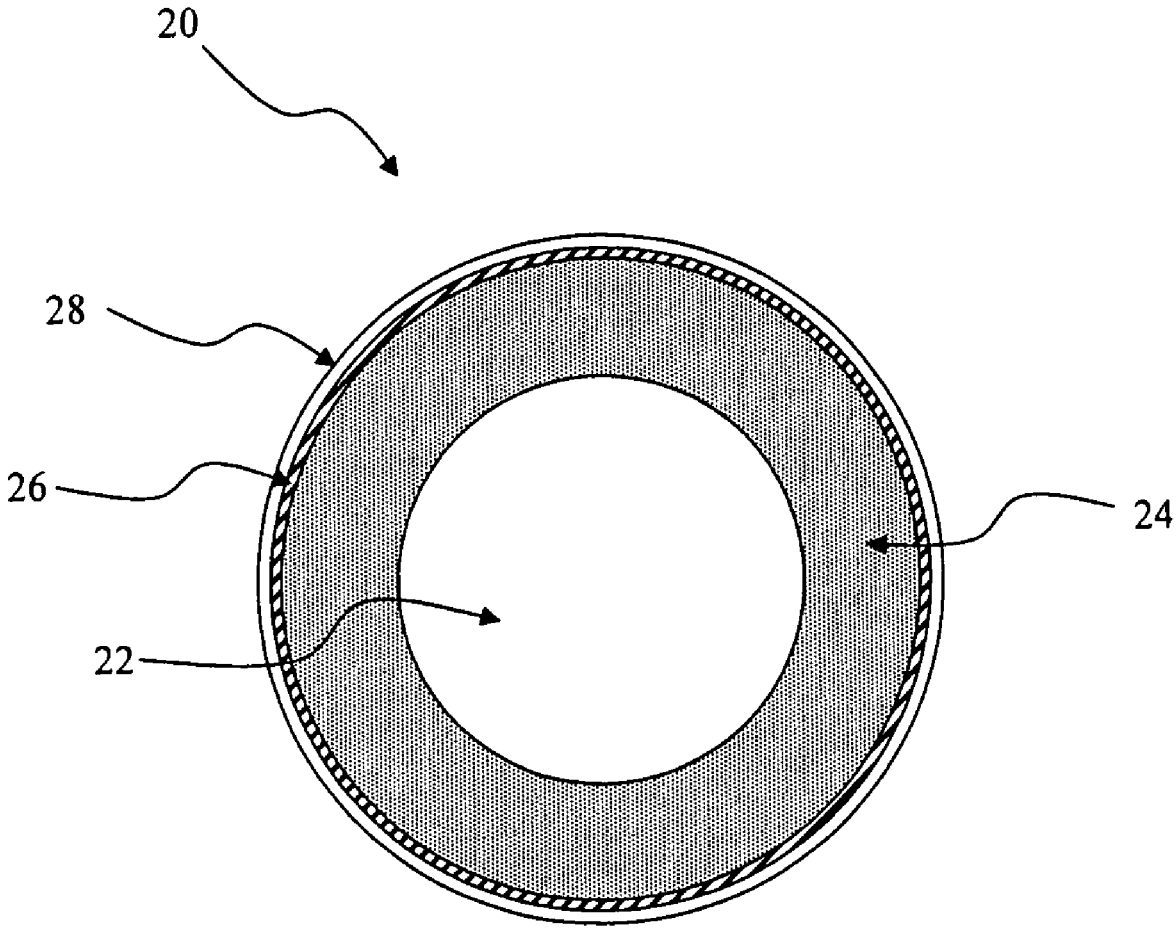
FIG. 6 is a cross-sectional view of a multi-component golf ball including a core, an outer core layer, a thin inner cover layer, and a thin outer cover layer disposed thereon, wherein at least a portion of the golf ball is formed from the compositions of the invention.

FIG. 6 illustrates a four-piece golf ball 20 according to the invention including a core 22, an outer core layer or intermediate layer 24, an inner cover layer or intermediate layer 26, and an outer cover layer 28. Any of the core 22, outer core or intermediate layer 24, or inner cover or intermediate layer 26 may include the MHCs of the invention. In one embodiment, the outer core layer 24 and the inner cover layer 26 are both formed of the MHCs of the invention, which is then enclosed by a thermoset or thermoplastic polyurethane or polyurea outer cover layer 28. In another embodiment, the composition of outer cover layer 28 also includes an MHC.

Other non-limiting examples of suitable types of ball constructions that may be used with the present invention include those described in U.S. Pat. Nos. 7,090,798, 7,101,944, 6,685,579, 6,548,618, 6,056,842, 5,688,191, 5,713,801, 5,803,831, 5,885,172, 5,919,100, 5,965,669, 5,981,654, 5,981,658, and 6,149,535. The entire disclosures of these patents are incorporated by reference herein. For example, in U.S. Pat. No. 6,685,579, a golf ball having three or more cover layers is disclosed, of which any of the layers of the ball may be formed using the MHCs of the invention.

As discussed, the golf balls of the invention include at least one MHC according to the invention. In addition, as discussed below, the golf balls of the invention may include core layers, intermediate layers, or cover layers formed from materials known to those of skill in the art. These examples are not exhaustive, as skilled artisans would be aware that a variety of materials might be used to produce a golf ball of the invention with desired performance properties.

Core Layer(s)

The cores of the golf balls formed according to the invention may be solid, semi-solid, hollow, fluid-filled, or powder filled. As used herein, the term "core" means the innermost portion of a golf ball, and may include one or more layers. For example, U.S. Pat. Nos. 6,180,040 and 6,180,722 disclose methods of preparing dual core golf balls. The entire disclosures of these patents are incorporated by reference herein. The term "semi-solid" as used herein refers to a paste, a gel, or the like. The cores of the golf balls of the invention may be spherical, cubical, pyramid-shaped, geodesic, or any three-dimensional, symmetrical shape.

While the cores of the invention may be formed with a MHC according to the invention, conventional materials may also be used to form the cores. Suitable core materials include, but are not limited to, thermoset materials, such as rubber, styrene butadiene, polybutadiene, isoprene, polyisoprene, trans-isoprene, and polyurethane, and thermoplastic materials, such as conventional ionomer resins, polyamides, polyesters, and polyurethane. In one embodiment, at least one layer of the core is formed from a polybutadiene reaction product, such as the reaction products disclosed in U.S. Pat. No. 6,998,445, the entire disclosure of which is incorporated by reference herein.

Additional materials may be included in the core layer compositions outlined above. For example, catalysts, coloring agents, optical brighteners, crosslinking agents, whitening agents such as $TiO_2$ and ZnO, UV absorbers, hindered amine light stabilizers, defoaming agents, processing aids, surfactants, and other conventional additives may be added to the core layer compositions of the invention. In addition, antioxidants, stabilizers, softening agents, plasticizers, including internal and external plasticizers, impact modifiers, foaming agents, density-adjusting fillers, reinforcing materials, and compatibilizers may also be added to any of the core layer compositions. One of ordinary skill in the art should be aware of the requisite amount for each type of additive to realize the benefits of that particular additive.

The core may also include one or more wound layers (surrounding a fluid or solid center) including at least one tensioned elastomeric material wound about the center. In one embodiment, the tensioned elastomeric material includes natural or synthetic elastomers or blends thereof. The synthetic elastomer preferably includes LYCRA. In another embodiment, the tensioned elastomeric material incorporates a polybutadiene reaction product as disclosed in U.S. Pat. No. 6,998,445. In yet another embodiment, the tensioned elastomeric material may also be formed from conventional polyisoprene. In still another embodiment, a polyurea composition (as disclosed in U.S. Pat. No. 6,835,794, which is incorporated by reference in its entirety by reference herein) is used to form the tensioned elastomeric material. In another embodiment, solvent spun polyethers urea, as disclosed in U.S. Pat. No. 6,149,535, is used to form the tensioned elastomeric material in an effort to achieve a smaller cross-sectional area with multiple strands. The entire disclosures of these patent applications and issued patents are incorporated by reference herein.

In another aspect of the invention, the golf balls of the invention include a thin, highly filled layer, such as the ones disclosed in U.S. Pat. No. 6,494,795, which is incorporated by reference herein in its entirety. A thin, highly filled core layer allows the weight or mass of the golf ball to be allocated radially relative to the centroid, thereby dictating the moment of inertia of the ball. When the weight is allocated radially toward the centroid, the moment of inertia is decreased, and when the weight is allocated outward away from the centroid, the moment of inertia is increased.

For example, a low moment of inertia ball can be formed using a high specific gravity core layer encompassed by a low specific gravity layer. The low specific gravity layer may be formed using a density reducing filler or by some other means, e.g., by foaming. In this aspect of the invention, the core layer may have the highest specific gravity of all the layers in the golf ball. In one embodiment, the specific gravity of the core layer is greater than about 1.8, preferably greater than about 2.0, and more preferably greater than about 2.5. In another embodiment, the specific gravity of the core layer is about 5 or greater. In yet another embodiment, the specific gravity of the core layer is about 10 or greater.

In one embodiment, the highly filled layer is the center of the ball or the outer core layer, or both. This high specific gravity core layer may be formed from the radiation-curable compositions of the invention, which include the appropriate fillers to raise the specific gravity to the requisite amount. Alternatively, the highly filled core layer may be made from a high density metal or from metal powder encased in a polymeric binder. High density metals such as steel, tungsten, lead, brass, bronze, copper, nickel, molybdenum, or alloys may be used.

Intermediate Layer(s)

As used herein, "intermediate layer" includes any layer between the innermost layer of the golf ball and the outermost layer of the golf ball. Therefore, intermediate layers may also be referred to as outer core layers, inner cover layers, and the like. When the golf ball of the present invention includes an intermediate layer, this layer may include any materials known to those of ordinary skill in the art, including various thermoset and thermoplastic materials, as well as blends thereof. For example, the intermediate layers of the golf ball of the invention may be formed with a MHC. The intermediate layer may likewise be formed, at least in part, from one or more homopolymeric or copolymeric materials, such as vinyl resins, polyolefins, polyurethanes, polyureas, polyamides, acrylic resins, olefinic thermoplastic rubbers, block copolymers of styrene and butadiene, isoprene or ethylene-butylene rubber, copoly(ether-amide), polyphenylene oxide resins, thermoplastic polyesters, ethylene, propylene, 1-butene or 1-hexene based homopolymers or copolymers, and the like.

The intermediate layer may also be formed from highly neutralized polymers such as those disclosed U.S. Pat. Nos. 6,565,455 and 6,565,456, which are incorporated herein in their entirety by express reference thereto; grafted and non-grafted metallocene catalyzed polyolefins and polyamides, polyamide/ionomer blends, and polyamide/nonionomer blends, such as those disclosed in U.S. Pat. No. 6,800,690, which is incorporated by reference herein in its entirety; among other polymers. Examples of other suitable intermediate layer materials include blends of some of the above materials, such as those disclosed in U.S. Pat. No. 5,688,181, the entire disclosure of which is incorporated by reference herein.

Additional materials may be included in the intermediate layer compositions outlined above. For example, catalysts, coloring agents, optical brighteners, crosslinking agents, whitening agents such as $TiO_2$ and ZnO, UV absorbers, hindered amine light stabilizers, defoaming agents, processing aids, surfactants, and other conventional additives may be added to the intermediate layer compositions of the invention. In addition, antioxidants, stabilizers, softening agents, plasticizers, including internal and external plasticizers, impact modifiers, foaming agents, density-adjusting fillers, reinforcing materials, and compatibilizers may also be added to any of the intermediate layer compositions. One of ordinary skill in the art should be aware of the requisite amount for each type of additive to realize the benefits of that particular additive.

The intermediate layer may also be formed of a binding material and an interstitial material distributed in the binding material, as discussed in U.S. Pat. No. 6,629,898, the entire disclosure of which is incorporated by reference herein. In addition, at least one intermediate layer may also be a moisture barrier layer, such as the ones described in U.S. Pat. No. 5,820,488, which is incorporated in its entirety by reference herein. The intermediate layer may also be formed from any of the polyurethane, polyurea, and polybutadiene materials discussed in U.S. Pat. No. 6,835,794.

Cover Layers

The cover provides the interface between the ball and a club. As used herein, the term "cover" means the outermost portion of a golf ball. A cover typically includes at least one layer and may contain indentations such as dimples and/or ridges. Paints and/or laminates are typically disposed about the cover to protect the golf ball during use thereof. The cover may include a plurality of layers, e.g., an inner cover layer disposed about a golf ball center and an outer cover layer formed thereon.

The cover layers may be formed of a MHC. Alternatively, the inner and/or outer cover layers of golf balls of the present invention may be formed of the ionomer compositions (partially, highly, or fully neutralized), other cover materials known to those of skill in the art, or blends thereof. For example, the cover may be formed of polyurea, polyurethane, or mixtures thereof, as disclosed in U.S. Pat. Nos. 6,835,794 and 7,041,769. The entire disclosures of these applications are incorporated by reference herein.

In addition, cover layers may also be formed of one or more homopolymeric or copolymeric materials, such as vinyl resins, polyolefins, conventional polyurethanes and polyureas, such as the ones disclosed in U.S. Pat. Nos. 5,334,673, and 5,484,870, polyamides, acrylic resins and blends of these resins with poly vinyl chloride, elastomers, and the like, thermoplastic urethanes, olefinic thermoplastic rubbers, block copolymers of styrene and butadiene, polyphenylene oxide resins or blends of polyphenylene oxide with high impact polystyrene, thermoplastic polyesters, ethylene, propylene, 1-butene or 1-hexane based homopolymers or copolymers including functional monomers, methyl acrylate, methyl methacrylate homopolymers and copolymers, low acid ionomers, high acid ionomers, alloys, and mixtures thereof. The cover may also be at least partially formed from a polybutadiene reaction product.

Additional materials may be included in the cover layer compositions outlined above. For example, catalysts, coloring agents, optical brighteners, crosslinking agents, whitening agents such as $TiO_2$ and ZnO, UV absorbers, hindered amine light stabilizers, defoaming agents, processing aids, surfactants; and other conventional additives may be added to the cover layer compositions of the invention. In addition, antioxidants, stabilizers, softening agents, plasticizers, including internal and external plasticizers, impact modifiers, foaming agents, density-adjusting fillers, reinforcing materials, and compatibilizers may also be added to any of the cover layer compositions. Those of ordinary skill in the art should be aware of the requisite amount for each type of additive to realize the benefits of that particular additive.

Furthermore, while hardness gradients are typically used in a golf ball to achieve certain characteristics, the present invention also contemplates the compositions of the invention being used in a golf ball with multiple cover layers having essentially the same hardness, wherein at least one of the layers has been modified in some way to alter a property that affects the performance of the ball. Such ball constructions are disclosed in U.S. Patent Publication No. 2003/0232666, the entire disclosure of which is incorporated by reference herein.

As discussed above with respect to the core of the golf balls of the invention, the use of a thin, highly filled layer allows the weight or mass of the golf ball to be allocated radially relative to the centroid, thereby dictating the moment of inertia of the ball. This concept is translatable to the cover layers of a golf ball. Thus, the inner cover layer may be a thin, dense layer so as to form a high moment of inertia ball. In this aspect of the invention, the inner cover layer preferably has a specific gravity of greater than 1.2, more preferably more than 1.5, even more preferably more than 1.8, and most preferably more than 2.0. Suitable materials for the thin, dense layer include any material that meets the specific gravity stated above. For example, this thin, highly filled inner cover layer may be formed of the radiation-curable compositions of the invention, adjusting for the requisite specific gravity. Alternatively, the inner cover layer may be formed from epoxies, styrenated polyesters, polyurethanes or polyureas, liquid PBR's, silicones, silicate gels, agar gels, and the like.

Methods for Forming

The golf balls of the invention may be formed using a variety of application techniques such as compression molding, flip molding, injection molding, retractable pin injection molding, reaction injection molding (RIM), liquid injection molding (LIM), casting, vacuum forming, powder coating, flow coating, spin coating, dipping, spraying, and the like. A method of injection molding using a split vent pin can be found in U.S. Pat. No. 6,877,974. Examples of retractable pin injection molding may be found in U.S. Pat. Nos. 6,129,881, 6,235,230, and 6,379,138. These molding references are incorporated in their entirety by reference herein.

One skilled in the art would appreciate that the molding method used may be determined at least partially by the properties of the composition. For example, casting, RIM, or LIM may be preferred when the material is thermoset, whereas compression molding or injection molding may be preferred for thermoplastic compositions. Compression molding, however, may also be used for thermoset inner ball materials. For example, when cores are formed from a thermoset material, compression molding is a particularly suitable method of forming the core, whereas when the cores are formed of a thermoplastic material, the cores may be injection molded. In addition, the intermediate layer may also be formed from using any suitable method known to those of ordinary skill in the art. For example, an intermediate layer may be formed by blow molding and covered with a dimpled cover layer formed by injection molding, compression molding, casting, vacuum forming, powder coating, and the like.

In addition, when covers for the golf balls of the invention are formed of polyurea and/or polyurethane compositions, these materials may be applied over an inner ball using a variety of application techniques such as spraying, compression molding, dipping, spin coating, casting, or flow coating methods that are well known in the art. Examples of forming polyurea and polyurethane materials about an inner ball are disclosed in U.S. Pat. Nos. 5,733,428, 5,006,297, and 5,334,673, which are incorporated by reference in their entirety herein. In one embodiment, a combination of casting and compression molding can be used to form a polyurethane or polyurea composition over an inner ball. However, the method of forming covers according to the invention is not limited to the use of these techniques; other methods known to those skilled in the art may also be employed.

While the MPCs of the invention improve adhesion between layers, prior to forming the cover layer, the inner ball, i.e., the core and any intermediate layers disposed thereon, may be surface treated to further increase the adhesion between the outer surface of the inner ball and the cover. Examples of such surface treatment may include mechanically or chemically abrading the outer surface of the subassembly. Additionally, the inner ball may be subjected to corona discharge, plasma treatment, and/or silane dipping prior to forming the cover around it. Other layers of the ball, e.g., the core, also may be surface treated. Examples of these and other surface treatment techniques can be found in U.S. Pat. No. 6,315,915, which is incorporated by reference in its entirety.

The methods discussed herein and other manufacturing methods for forming the golf ball components of the present invention are also disclosed in U.S. Pat. Nos. 6,207,784 and 5,484,870, the disclosures of which are incorporated herein by reference in their entirety.

Dimples

The golf balls of the invention are prefereably designed with certain flight characteristics in mind. The use of various dimple patterns and profiles provides a relatively effective way to modify the aerodynamic characteristics of a golf ball. As such, the manner in which the dimples are arranged on the surface of the ball can be by any available method. For instance, the ball may have an icosahedron-based pattern, such as described in U.S. Pat. No. 4,560,168, or an octahedral-based dimple patterns as described in U.S. Pat. No. 4,960,281. Alternatively, the dimple pattern can be arranged according to phyllotactic patterns, such as described in U.S. Pat. No. 6,338,684, which is incorporated herein in its entirety.

Dimple patterns may also be based on Archimedean patterns including a truncated octahedron, a great rhombcuboctahedron, a truncated dodecahedron, and a great rhombicosidodecahedron, wherein the pattern has a non-linear parting line, as disclosed in U.S. Pat. No. 6,705,959, which is incorporated in its entirety by reference herein. The golf balls of the present invention may also be covered with non-circular shaped dimples, i.e., amorphous shaped dimples, as disclosed in U.S. Pat. No. 6,409,615, which is incorporated in its entirety by reference herein.

Dimple patterns that provide a high percentage of surface coverage are preferred, and are well known in the art. For example, U.S. Pat. Nos. 5,562,552, 5,575,477, 5,957,787, 5,249,804, and 4,925,193 disclose geometric patterns for positioning dimples on a golf ball. In one embodiment, the golf balls of the invention have a dimple coverage of the surface area of the cover of at least about 60 percent, preferably at least about 65 percent, and more preferably at least 70 percent or greater. Dimple patterns having even higher dimple coverage values may also be used with the present invention. Thus, the golf balls of the present invention may have a dimple coverage of at least about 75 percent or greater, about 80 percent or greater, or even about 85 percent or greater.

In addition, a tubular lattice pattern, such as the one disclosed in U.S. Pat. No. 6,290,615, which is incorporated by reference in its entirety herein, may also be used with golf balls of the present invention. The golf balls of the present invention may also have a plurality of pyramidal projections disposed on the intermediate layer of the ball, as disclosed in U.S. Pat. No. 6,383,092, which is incorporated in its entirety by reference herein. The plurality of pyramidal projections on the golf ball may cover between about 20 percent to about 80 of the surface of the intermediate layer.

In an alternative embodiment, the golf ball may have a non-planar parting line allowing for some of the plurality of pyramidal projections to be disposed about the equator. Such a golf ball may be fabricated using a mold as disclosed in U.S. patent application Ser. No. 09/442,845, filed Nov. 18, 1999, entitled "Mold For A Golf Ball," and which is incorporated in its entirety by reference herein. This embodiment allows for greater uniformity of the pyramidal projections. Several additional non-limiting examples of dimple patterns with varying sizes of dimples are also provided in U.S. Pat. Nos. 6,358,161 and 6,213,898, the entire disclosures of which are incorporated by reference herein.

The total number of dimples on the ball, or dimple count, may vary depending such factors as the sizes of the dimples and the pattern selected. In general, the total number of dimples on the ball preferably is between about 100 to about 1000 dimples, although one skilled in the art would recognize that differing dimple counts within this range can significantly alter the flight performance of the ball. In one embodiment, the dimple count is about 380 dimples or greater, but more preferably is about 400 dimples or greater, and even more preferably is about 420 dimples or greater. In one embodiment, the dimple count on the ball is about 422 dimples. In some cases, it may be desirable to have fewer dimples on the ball. Thus, one embodiment of the present invention has a dimple count of about 380 dimples or less, and more preferably is about 350 dimples or less.

Dimple profiles revolving a catenary curve about its symmetrical axis may increase aerodynamic efficiency, provide a convenient way to alter the dimples to adjust ball performance without changing the dimple pattern, and result in uniformly increased flight distance for golfers of all swing speeds. Thus, catenary curve dimple profiles, as disclosed in U.S. Pat. No. 6,796,912, which is incorporated in its entirety by reference herein, is contemplated for use with the golf balls of the present invention.

Golf Ball Post-Processing

The golf balls of the present invention may be painted, coated, or surface treated for further benefits. For example, a golf ball of the invention may be treated with a base resin paint composition or the cover composition may contain certain additives to achieve a desired color characteristic. In one embodiment, the golf ball cover composition contains a fluorescent whitening agent, e.g., a derivative of 7-triazinylamino-3-phenylcoumarin, to provide improved weather resistance and brightness. An example of such a fluorescent whitening agent is disclosed in U.S. Patent Publication No. 2002/0082358, which is incorporated by reference herein in its entirety.

Protective and decorative coating materials, as well as methods of applying such materials to the surface of a golf ball cover are well known in the golf ball art. Generally, such coating materials comprise urethanes, urethane hybrids, epoxies, polyesters and acrylics.

The coating layer(s) may be applied by any suitable method known to those of ordinary skill in the art. For example, the coating layer(s) may be applied to the golf ball cover by an in-mold coating process, such as described in U.S. Pat. No. 5,849,168, which is incorporated in its entirety by reference herein. In addition, the golf balls of the invention may be painted or coated with an ultraviolet curable/treatable ink, by using the methods and materials disclosed in U.S. Pat. Nos. 6,500,495, 6,248,804, and 6,099,415, the entire disclosures of which are incorporated by reference herein.

Any trademarks or other indicia that may be used with the present inveniton may be applied to the ball through a variety of methods known to those of skill in the golf ball manufacturing art. In one embodiment, the indicia is stamped, i.e., pad-printed, on the outer surface of the ball cover, and the stamped outer surface is then treated with at least one clear coat to give the ball a glossy finish and protect the indicia stamped on the cover. In another embodiment, the indicia is applied to the intended layer by ink-jet printing. And, if desired, more than one coating layer can be used.

Golf Ball Properties

The properties such as hardness, modulus, core diameter, intermediate layer thickness and cover layer thickness of the golf balls of the present invention have been found to effect play characteristics such as spin, initial velocity and feel of the present golf balls. For example, the flexural and/or tensile modulus of the intermediate layer are believed to have an effect on the "feel" of the golf balls of the present invention. It should be understood that the ranges herein are meant to be intermixed with each other, i.e., the low end of one range may be combined with a high end of another range.

Component Dimensions

Dimensions of golf ball components, i.e., thickness and diameter, may vary depending on the desired properties. For the purposes of the invention, any layer thickness may be employed. Non-limiting examples of the various embodiments outlined above are provided here with respect to layer dimensions.

The present invention relates to golf balls of any size. While USGA specifications limit the size of a competition golf ball to more than 1.68 inches in diameter, golf balls of any size can be used for leisure golf play. The preferred diameter of the golf balls is from about 1.68 inches to about 1.8 inches. The more preferred diameter is from about 1.68 inches to about 1.76 inches. A diameter of from about 1.68 inches to about 1.74 inches is most preferred, however diameters anywhere in the range of from 1.7 to about 1.95 inches can be used. Preferably, the overall diameter of the core and all intermediate layers is about 80 percent to about 98 percent of the overall diameter of the finished ball.

The core may have a diameter ranging from about 0.09 inches to about 1.65 inches. In one embodiment, the diameter of the core of the present invention is about 1.2 inches to about 1.630 inches. In another embodiment, the diameter of the core is about 1.3 inches to about 1.6 inches, preferably from about 1.39 inches to about 1.6 inches, and more preferably from about 1.5 inches to about 1.6 inches. In yet another embodiment, the core has a diameter of about 1.55 inches to about 1.65 inches.

The core of the golf ball may also be extremely large in relation to the rest of the ball. For example, in one embodiment, the core makes up about 90 percent to about 98 percent of the ball, preferably about 94 percent to about 96 percent of the ball. In this embodiment, the diameter of the core is preferably about 1.54 inches or greater, preferably about 1.55 inches or greater. In one embodiment, the core diameter is about 1.59 inches or greater. In another embodiment, the diameter of the core is about 1.64 inches or less.

When the core includes an inner core layer and an outer core layer, the inner core layer is preferably about 0.9 inches or greater and the outer core layer preferably has a thickness of about 0.1 inches or greater. In one embodiment, the inner core layer has a diameter from about 0.09 inches to about 1.2 inches and the outer core layer has a thickness from about 0.1 inches to about 0.8 inches. In yet another embodiment, the inner core layer diameter is from about 0.095 inches to about 1.1 inches and the outer core layer has a thickness of about 0.20 inches to about 0.03 inches.

If the composition of the invention is used as an outer core layer, the cured thickness of the layer is preferably about 0.001 inches to about 0.1 inches. In one embodiment, the outer core layer's cured thickness is about 0.002 inches to about 0.05 inches. In another embodiment, the cured thickness of the outer core layer is about 0.003 inches to about 0.03 inches.

The cover typically has a thickness to provide sufficient strength, good performance characteristics, and durability. In one embodiment, the cover thickness is from about 0.02 inches to about 0.35 inches. In another embodiment, the cover preferably has a thickness of about 0.02 inches to about 0.12 inches, preferably about 0.1 inches or less, more preferably about 0.07 inches or less. In yet another embodiment, the outer cover has a thickness from about 0.02 inches to about 0.07 inches. In still another embodiment, the cover thickness is about 0.05 inches or less, preferably from about 0.02 inches to about 0.05 inches. For example, the outer cover layer may be between about 0.02 inches and about 0.045 inches, preferably about 0.025 inches to about 0.04 inches thick. In one embodiment, the outer cover layer is about 0.03 inches thick.

The range of thicknesses for an intermediate layer of a golf ball is large because of the vast possibilities when using an intermediate layer, i.e., as an outer core layer, an inner cover layer, a wound layer, a moisture/vapor barrier layer. When used in a golf ball of the invention, the intermediate layer, or inner cover layer, may have a thickness about 0.3 inches or less. In one embodiment, the thickness of the intermediate layer is from about 0.002 inches to about 0.1 inches, preferably about 0.01 inches or greater. In one embodiment, the thickness of the intermediate layer is about 0.09 inches or less, preferably about 0.06 inches or less. In another embodiment, the intermediate layer thickness is about 0.05 inches or less, more preferably about 0.01 inches to about 0.045 inches. In one embodiment, the intermediate layer, thickness is about 0.02 inches to about 0.04 inches. In another embodiment, the intermediate layer thickness is from about 0.025 inches to about 0.035 inches. In yet another embodiment, the thickness of the intermediate layer is about 0.035 inches thick. In still another embodiment, the inner cover layer is from about 0.03 inches to about 0.035 inches thick. Varying combinations of these ranges of thickness for the intermediate and outer cover layers may be used in combination with other embodiments described herein.

The ratio of the thickness of the intermediate layer to the outer cover layer is preferably about 10 or less, preferably from about 3 or less. In another embodiment, the ratio of the thickness of the intermediate layer to the outer cover layer is about 1 or less. The core and intermediate layer(s) together form an inner ball preferably having a diameter of about 1.48 inches or greater for a 1.68-inch ball. In one embodiment, the inner ball of a 1.68-inch ball has a diameter of about 1.52 inches or greater. In another embodiment, the inner ball of a 1.68-inch ball has a diameter of about 1.66 inches or less. In yet another embodiment, a 1.72-inch (or more) ball has an inner ball diameter of about 1.50 inches or greater. In still another embodiment, the diameter of the inner ball for a 1.72-inch ball is about 1.70 inches or less.

Hardness

Most golf balls consist of layers having different hardnesses, e.g., hardness gradients, to achieve desired performance characteristics. The present invention contemplates golf balls having hardness gradients between layers, as well as those golf balls with layers having the same hardness.

It should be understood, especially to one of ordinary skill in the art, that there is a fundamental difference between "material hardness" and "hardness, as measured directly on a golf ball." Material hardness is defined by the procedure set forth in ASTM-D2240 and generally involves measuring the hardness of a flat "slab" or "button" formed of the material of which the hardness is to be measured. Hardness, when measured directly on a golf ball (or other spherical surface) is a completely different measurement and, therefore, results in a different hardness value. This difference results from a number of factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other.

The cores of the present invention may have varying hardnesses depending on the particular golf ball construction. In one embodiment, the core hardness is at least about 15 Shore A, preferably about 30 Shore A, as measured on a formed sphere. In another embodiment, the core has a hardness of about 50 Shore A to about 90 Shore D. In yet another embodiment, the hardness of the core is about 80 Shore D or less. Preferably, the core has a hardness about 30 to about 65 Shore D, and more preferably, the core has a hardness about 35 to about 60 Shore D.

The intermediate layer(s) of the present invention may also vary in hardness depending on the specific construction of the ball. In one embodiment, the hardness of the intermediate layer is about 30 Shore D or greater. In another embodiment, the hardness of the intermediate layer is about 90 Shore D or less, preferably about 80 Shore D or less, and more preferably about 70 Shore D or less. In yet another embodiment, the hardness of the intermediate layer is about 50 Shore D or greater, preferably about 55 Shore D or greater. In one embodiment, the intermediate layer hardness is from about 55 Shore D to about 65 Shore D. The intermediate layer may also be about 65 Shore D or greater.

When the intermediate layer is intended to be harder than the core layer, the ratio of the intermediate layer hardness to the core hardness preferably about 2 or less. In one embodiment, the ratio is about 1.8 or less. In yet another embodiment, the ratio is about 1.3 or less.

As with the core and intermediate layers, the cover hardness may vary depending on the construction and desired characteristics of the golf ball. The ratio of cover hardness to inner ball hardness is a primary variable used to control the aerodynamics of a ball and, in particular, the spin of a ball. In general, the harder the inner ball, the greater the driver spin and the softer the cover, the greater the driver spin.

F or example, when the intermediate layer is intended to be the hardest point in the ball, e.g., about 50 Shore D to about 75 Shore D, the cover material may have a hardness of about 20 Shore D or greater, preferably about 25 Shore D or greater, and more preferably about 30 Shore D or greater, as measured on the slab. In another embodiment, the cover itself has a hardness of about 30 Shore D or greater. In particular, the cover may be from about 30 Shore D to about 70 Shore D. In one embodiment, the cover has a hardness of about 40 Shore D to about 65 Shore D, and in another embodiment, about 40 Shore to about 55 Shore D. In another aspect of the invention, the cover has a hardness less than about 45 Shore D, preferably less than about 40 Shore D, and more preferably about 25 Shore D to about 40 Shore D. In one embodiment, the cover has a hardness from about 30 Shore D to about 40 Shore D.

In this embodiment when the outer cover layer is softer than the intermediate layer or inner cover layer, the ratio of the Shore D hardness of the outer cover material to the intermediate layer material is about 0.8 or less, preferably about 0.75 or less, and more preferably about 0.7 or less. In another embodiment, the ratio is about 0.5 or less, preferably about 0.45 or less.

In yet another embodiment, the ratio is about 0.1 or less when the cover and intermediate layer materials have hardnesses that are substantially the same. When the hardness differential between the cover layer and the intermediate layer is not intended to be as significant, the cover may have a hardness of about 55 Shore D to about 65 Shore D. In this embodiment, the ratio of the Shore D hardness of the outer cover to the intermediate layer is about 1.0 or less, preferably about 0.9 or less.

The cover hardness may also be defined in terms of Shore C. For example, the cover may have a hardness of about 70 Shore C or greater, preferably about 80 Shore C or greater. In another embodiment, the cover has a hardness of about 95 Shore C or less, preferably about 90 Shore C or less.

In another embodiment, the cover layer is harder than the intermediate layer. In this design, the ratio of Shore D hardness of the cover layer to the intermediate layer is about 1.33 or less, preferably from about 1.14 or less.

When a two-piece ball is constructed, the core may be softer than the outer cover. For example, the core hardness may range from about 30 Shore D to about 50 Shore D, and the cover hardness may be from about 50 Shore D to about 80 Shore D. In this type of construction, the ratio between the cover hardness and the core hardness is preferably about 1.75 or less. In another embodiment, the ratio is about 1.55 or less. Depending on the materials, for example, if a composition of the invention is acid-functionalized wherein the acid groups are at least partially neutralized, the hardness ratio of the cover to core is preferably about 1.25 or less.

Compression

Compression values are dependent on the diameter of the component being measured. Atti compression is typically used to measure the compression of a golf ball. As used herein, the terms "Atti compression" or "compression" are defined as the deflection of an object or material relative to the deflection of a calibrated spring, as measured with an Atti Compression Gauge, that is commercially available from Atti Engineering Corp. of Union City, N.J.

The Atti compression of the core, or portion of the core, of golf balls prepared according to the invention is preferably less than about 80, more preferably less than about 75. In another embodiment, the core compression is from about 40 to about 80, preferably from about 50 to about 70. In yet another embodiment, the core compression is preferably below about 50, and more preferably below about 25. In an alternative, low compression embodiment, the core has a compression less than about 20, more preferably less than about 10, and most preferably, 0. As known to those of ordinary skill in the art, however, the cores generated according to the present invention may be below the measurement of the Atti Compression Gauge.

In one embodiment, golf balls of the invention preferably have an Atti compression of about 55 or greater, preferably from about 60 to about 120. In another embodiment, the Atti compression of the golf balls of the invention is at least about 40, preferably from about 50 to 120, and more preferably from about 60 to 100. In yet another embodiment, the compression of the golf balls of the invention is about 75 or greater and about 95 or less. For example, a preferred golf ball of the invention may have a compression from about 80 to about 95.

Initial Velocity and COR

There is currently no USGA limit on the COR of a golf ball, but the initial velocity of the golf ball cannot exceed 250±5 feet/second (ft/s). Thus, in one embodiment, the initial velocity is about 245 ft/s or greater and about 255 ft/s or greater. In another embodiment, the initial velocity is about 250 ft/s or greater. In one embodiment, the initial velocity is about 253 ft/s to about 254 ft/s. In yet another embodiment, the initial velocity is about 255 ft/s. While the current rules on initial velocity require that golf ball manufacturers stay within the limit, one of ordinary skill in the art would appreciate that the golf ball of the invention would readily convert into a golf ball with initial velocity outside of this range. For example, a golf ball of the invention may be designed to have an initial velocity of about 220 ft/s or greater, preferably about 225 ft/s or greater.

As a result, of the initial velocity limitation set forth by the USGA, the goal is to maximize COR without violating the 255 ft/s limit. The COR of a ball is measured by taking the ratio of the outbound or rebound velocity to the incoming or inbound velocity. In a one-piece solid golf ball, the COR will depend on a variety of characteristics of the ball, including its composition and hardness. For a given composition, COR will generally increase as hardness is increased. In a two-piece solid golf ball, e.g., a core and a cover, one of the purposes of the cover is to produce a gain in COR over that of the core. When the contribution of the core to high COR is substantial, a lesser contribution is required from the cover. Similarly, when the cover contributes substantially to high COR of the ball, a lesser contribution is needed from the core.

The present invention contemplates golf balls having CORs from about 0.700 to about 0.850 at an inbound velocity of about 125 ft/sec. In one embodiment, the COR is about 0.750 or greater, preferably about 0.780 or greater. In another embodiment, the ball has a COR of about 0.800 or greater. In yet another embodiment, the COR of the balls of the invention is about 0.800 to about 0.815.

In addition, the inner ball preferably has a COR of about 0.780 or more. In one embodiment, the COR is about 0.790 or greater.

Spin Rate

As known to those of ordinary skill in the art, the spin rate of a golf ball will vary depending on the golf ball construction. In a multilayer ball, e.g., a core, an intermediate layer, and a cover, wherein the cover is formed from the polyurea or polyurethane compositions of the invention, the spin rate of the ball off a driver ("driver spin rate") may be about 2000 rpm or greater. In one embodiment, the driver spin rate is about 2000 rpm to about 3500 rpm. In another embodiment, the driver spin rate is about 2200 rpm to about 3400 rpm. In still another embodiment, the driver spin rate may be less than about 2700 rpm.

Two-piece balls made according to the invention may also have driver spin rates of 1500 rpm and greater. In one embodiment, the driver spin rate is about 2000 rpm to about 3300 rpm. Wound balls made according to the invention preferably have similar spin rates.

Methods of determining the spin rate should be well understood by those of ordinary skill in the art. Examples of methods for determining the spin rate are disclosed in U.S. Pat. Nos. 6,500,073, 6,488,591, 6,286,364, and 6,241,622, which are incorporated by reference herein in their entirety.

Flexural Modulus

Accordingly, it is preferable that the golf balls of the present invention have an intermediate layer with a flexural modulus of about 500 psi to about 500,000 psi, measured according to ASTM D-6272-98. More preferably, the flexural modulus of the intermediate layer is about 1,000 psi to about 250,000 psi. Most preferably, the flexural modulus of the intermediate layer is about 2,000 psi to about 200,000 psi.

The flexural modulus of the cover layer is preferably about 2,000 psi or greater, and more preferably about 5,000 psi or greater. In one embodiment, the flexural modulus of the cover is from about 10,000 psi to about 150,000 psi. More preferably, the flexural modulus of the cover layer is about 15,000 psi to about 120,000 psi. Most preferably, the flexural modulus of the cover layer is about 18,000 psi to about 110,000 psi. In another embodiment, the flexural modulus of the cover layer is about 100,000 psi or less, preferably about 80,000 or less, and more preferably about 70,000 psi or less. For example, the flexural modulus of the cover layer may be from about 10,000 psi to about 70,000 psi, from about 12,000 psi to about 60,000 psi, or from about 14,000 psi to about 50,000 psi.

In one embodiment, when the cover layer has a hardness of about 50 Shore D to about 60 Shore D, the cover layer preferably has a flexural modulus of about 55,000 psi to about 65,000 psi.

In one embodiment, the ratio of the flexural modulus of the intermediate layer to the cover layer is about 0.003 to about 50. In another embodiment, the ratio of the flexural modulus of the intermediate layer to the cover layer is about 0.006 to about 4.5. In yet another embodiment, the ratio of the flexural modulus of the intermediate layer to the cover layer is about 0.11 to about 4.5.

In one embodiment, the compositions of the invention are used in a golf ball with multiple cover layers having essentially the same hardness, but differences in flexural moduli. In this aspect of the invention, the difference between the flexural moduli of the two cover layers is preferably about 5,000 psi or less. In another embodiment, the difference in flexural moduli is about 500 psi or greater. In yet another embodiment, the difference in the flexural moduli between the two cover layers, wherein at least one is reinforced is about 500 psi to about 10,000 psi, preferably from about 500 psi to about 5,000 psi. In one embodiment, the difference in flexural moduli between the two cover layers formed of unreinforced or unmodified materials is about 1,000 psi to about 2,500 psi.

Specific Gravity

The specific gravity of a cover or intermediate layer is preferably at least about 0.7. In one embodiment, the specific gravity of the intermediate layer or cover is about 0.8 or greater, preferably about 0.9 or greater. For example, in one embodiment, the golf ball has an intermediate layer with a specific gravity of about 0.9 or greater and a cover having a specific gravity of about 0.95 or greater. In another embodiment, the intermediate layer or cover has a specific gravity of about 1.00 or greater. In yet another embodiment, the specific gravity of the intermediate layer or cover is about 1.05 or greater, preferably about 1.10 or greater.

The core may have a specific gravity of about 1.00 or greater, preferably 1.05 or greater. For example, a golf ball of the invention may have a core with a specific gravity of about 1.10 or greater and a cover with a specific gravity of about 0.95 or greater.

While it is apparent that the invention disclosed herein is well calculated to fulfill the objects stated above, it will be appreciated that numerous modifications and embodiments may be devised by those skilled in the art. For example, while golf balls and golf ball components are used as examples for articles incorporating the compositions of the invention, other golf equipment may be formed from the compositions of the invention. In one embodiment, at least a portion of a golf shoe is formed from the composition of the invention. In another embodiment, the composition of the invention is used to form at least a portion of a golf club, e.g., a putter insert. Therefore, it is intended that the appended claims cover all such modifications and embodiments that fall within the true spirit and scope of the present invention.

We claim:

1. A golf ball comprising at least one mechanically hybridized component comprising:

a first layer formed of a first composition comprising at least one polyolefin polymer and a plurality of microballoons comprising a thermoplastic shell, wherein the first layer comprises a network of interconnecting pores; and a second layer disposed thereon comprising a second composition, wherein the second composition fills the interconnecting pores to form the mechanically hybridized component.

2. The golf ball of claim 1, wherein the thermoplastic shell comprises (meth)acrylonitrile, (meth)acrylates, styrenic monomers, vinyl halides, vinylidene halides, vinyl acetate, butadiene, vinylpyridine, chloroprene, and mixtures thereof.

3. The golf ball of claim 1, wherein the microballoons have a diameter of about 30 μm to about 200 μm.

4. The golf ball of claim 1, wherein a first percentage of microballoons have a diameter of about 10 μm to about 200 μm and a second percentage of microballoons have a diameter of about 500 μm to about 1000 μm.

5. The golf ball of claim 1, wherein each microballoon comprises a blowing agent within the thermoplastic shell, and wherein the thermoplastic shell is expandable by about four to about five times the initial size.

6. The golf ball of claim 1, wherein the interconnecting pores have a volume average diameter of about 0.02 microns to about 50 microns.

7. The golf ball of claim 1, wherein the microballoons have diameters ranging from about 1 μm to about 1000 μm.

8. The golf ball of claim 1, wherein the interconnecting pores comprise about 35 percent or more of the volume of the first layer.

9. The golf ball of claim 8, wherein the interconnecting pores comprise about 60 percent or more of the volume of the first layer.

10. The golf ball of claim 1, wherein at least about 20 percent of the interconnecting pores have a diameter of about 0.1 μm to about 300 μm.

11. A golf ball comprising:

a core; and a mechanically hybridized component disposed about the core, wherein the mechanically hybridized component comprises:

a first layer comprising interconnecting pores and formed from a composition comprising a thermoplastic material and a plurality of porosity-generating agents selected from the group consisting of microballoons, nanotubes, macrospheres, or a combination thereof; and a second layer formed from a castable reactive liquid material, wherein the castable reactive liquid material fills the interconnecting pores in the first layer.

12. The golf ball of claim 11, wherein the thermoplastic material comprises a highly neutralized polymer having at least 80 percent of its acid groups neutralized.

13. The golf ball of claim 11, wherein the porosity-generating agents are microballoons each having a diameter ranging from about 1 μm to about 1000 μm.

14. The golf ball of claim 11, wherein the interconnecting pores comprise about 35 percent to about 95 percent of the volume of the first layer.

15. The golf ball of claim 11, wherein at least about 50 percent of the interconnecting pores have a diameter of about 0.3 μm to about 200 μm.

16. A golf ball comprising a core and a cover, wherein the cover is formed of a mechanically hybridized component comprising:

a first layer comprising a first composition comprising a polymer component and a plurality of porosity-generating agents each comprising a blowing agent, wherein the porosity-generating agents comprise microballoons having a diameter ranging from about 1 μm to about 1000 μm, and wherein the first layer comprises a first network of interconnecting pores; and a second layer comprising a second composition, wherein the second composition fills the first network of interconnecting pores to form the mechanically hybridized component.

17. The golf ball of claim 16, wherein the second layer further comprises a plurality of porosity-generating agents selected from the group consisting of microballoons, nanotubes, or a mixture thereof, and wherein the second layer further comprises a second network of interconnected pores.

18. The golf ball of claim 17, wherein the mechanically hybridized component further comprises a third layer disposed about the second layer, wherein the third layer is formed from a third composition, and wherein the third composition fills the second network of interconnected pores to form the mechanically hybridized component.

19. The golf ball of claim 16, wherein at least about 20 percent of the interconnecting pores have a diameter of about 0.3 μm to about 200 μm.

20. The golf ball of claim 16, wherein the interconnecting pores comprise about 60 percent or more of the volume of the first layer.

* * * * *